US011370630B2

(12) United States Patent
Yokawa et al.

(10) Patent No.: US 11,370,630 B2
(45) Date of Patent: Jun. 28, 2022

(54) SHEET STORAGE DEVICE AND SHEET PROCESSING APPARATUS

(71) Applicant: GLORY LTD., Hyogo (JP)

(72) Inventors: Takeshi Yokawa, Hyogo (JP); Kei Isshiki, Hyogo (JP)

(73) Assignee: GLORY LTD., Hyogo (JP)

( * ) Notice: Subject to any disclaimer, the term of this patent is extended or adjusted under 35 U.S.C. 154(b) by 314 days.

(21) Appl. No.: 16/568,723

(22) Filed: Sep. 12, 2019

(65) Prior Publication Data

US 2020/0087094 A1 Mar. 19, 2020

(30) Foreign Application Priority Data

Sep. 13, 2018 (JP) ..... JP2018-171429

(51) Int. Cl.

| | |
|---|---|
| ***B65H 5/28*** | (2006.01) |
| ***B65H 29/00*** | (2006.01) |
| ***B65H 1/00*** | (2006.01) |
| ***B65H 5/02*** | (2006.01) |

(52) U.S. Cl.

CPC ..... *B65H 29/006* (2013.01); *B65H 1/00* (2013.01); *B65H 5/023* (2013.01)

(58) Field of Classification Search

CPC ..... G07D 11/10; G07D 11/12; G07D 11/13; G07D 11/14; G07D 11/16; G07D 11/165; G07D 11/17; G07D 11/18; G07D 11/22; G07D 11/2322; G07D 11/00; B65H 5/28; B65H 29/006; B65H 29/008; B65H 29/12; B65H 29/125; B65H 2301/419; B65H 2301/4191; B65H 2301/41912

See application file for complete search history.

(56) References Cited

U.S. PATENT DOCUMENTS

| | | | | |
|---|---|---|---|---|
| 5,913,182 | A * | 6/1999 | Inoue | B41L 31/00 702/97 |
| 8,844,805 | B2 * | 9/2014 | Yokote | B65H 29/006 235/379 |
| 9,611,117 | B2 * | 4/2017 | Asamura | B65H 29/58 |
| 2010/0116839 | A1 * | 5/2010 | Michels | G07D 11/12 221/71 |

(Continued)

FOREIGN PATENT DOCUMENTS

| | | | |
|---|---|---|---|
| CN | 205602799 | U | 9/2016 |
| CN | 106164987 | A | 11/2016 |

(Continued)

*Primary Examiner* — Thomas A Morrison

(74) *Attorney, Agent, or Firm* — Greenblum & Bernstein, P.L.C.

(57) ABSTRACT

A sheet storage device includes a reel around which a tape is wound, a drum onto which a sheet is wound together with the tape, an input and output opening through which the sheet is passed, and a frame that forms at least a portion of a transport path on which the sheet is transported from the input and output opening to the drum, the frame has a first and a second frame part, the first and second frame parts move relative to each other to switch between a state in which the transport path is formed and a state in which at least a portion of the transport path is open, the first frame part supports the reel, and forms a tape path extending from the reel to the drum, the first frame part moves together with the reel and the tape path relative to the second frame part.

19 Claims, 15 Drawing Sheets

(56) References Cited

U.S. PATENT DOCUMENTS

| | | | | |
|---|---|---|---|---|
| 2010/0163571 | A1* | 7/2010 | Mizoro | B65H 29/006 221/71 |
| 2011/0233855 | A1 | 9/2011 | Herczeg et al. | |
| 2013/0186730 | A1 | 7/2013 | Tomiyoshi et al. | |
| 2013/0240321 | A1* | 9/2013 | Kashiwabuchi | G07D 11/16 194/206 |

FOREIGN PATENT DOCUMENTS

| | | | |
|---|---|---|---|
| JP | 2013-25707 | A | 2/2013 |
| WO | WO2015/178198 | | 11/2015 |

* cited by examiner

SHEET STORAGE DEVICE AND SHEET PROCESSING APPARATUS

CROSS-REFERENCE TO RELATED APPLICATION

This application claims priority to Japanese Patent Application No. 2018-171429 filed on Sep. 13, 2018, the entire disclosure of which is incorporated by reference herein.

BACKGROUND

The technology disclosed herein relates to sheet storage devices and sheet processing apparatuses.

Japanese Patent Publication No. 2013-25707 describes an automated teller machine provided with a temporary storage unit. The temporary storage unit is configured so that banknotes are sandwiched by an upper tape and a lower tape, and the tapes and the banknotes are wound onto a drum. The temporary storage unit is also configured so that an upper guide turns around a retraction shaft to open a banknote transport path.

When a banknote jam or the like occurs, a user can open the transport path of the temporary storage unit.

SUMMARY

However, in the temporary storage unit described in the publication above, when the upper guide turns around the retraction shaft, only a tape pulley attached to the upper guide is moved away from the center of the drum without the movement of the drum and a tape reel. As a result, the tape path between the drum and the tape reel is shortened, and therefore, the tape becomes slack between the drum and the tape reel.

In order to substantially prevent the slacking of the tape, a torsion spring is attached to the tape reel in the temporary storage unit described in the publication above. The torsion spring presses the tape reel in the direction in which the tape is wound. However, the torsion spring of the publication above presses the tape reel to exert tension on the tape even when the transport path is not open. Therefore, in the temporary storage unit described in the publication above, it is necessary to adjust the pressing force of the torsion spring so that the drum is not rotated by the pressing force of the torsion spring, or a locking mechanism or torque limiter mechanism for limiting live rotation of the drum needs to be provided in the temporary storage unit. Such a cumbersome adjustment and a complicated structure are drawbacks of the temporary storage unit of the publication above.

The technology disclosed herein simplifies the configuration of a sheet storage device in which the transport path can be opened.

Specifically, the technology disclosed herein is directed to a sheet storage device. The sheet storage device includes a reel around which a tape is wound, a drum onto which a sheet is wound together with the tape, an input and output opening through which the sheet is passed, and a frame configured to form at least a portion of a transport path on which the sheet is transported from the input and output opening to the drum.

The frame has a first frame part and a second frame part. The first frame part and the second frame part are configured to move relative to each other to switch between a state in which the transport path is formed and a state in which at least a portion of the transport path is open.

The first frame part supports the reel, and forms a tape path extending from the reel to the drum. The first frame part moves together with the reel and the tape path relative to the second frame part.

With this configuration, the tape is substantially prevented from becoming stack when a user opens at least a portion of the transport path. A part such as a torsion spring is not required, resulting in a simpler configuration of the sheet storage device.

The first frame part may turn together with the reel and the tape path around the center of rotation of the drum relative to the second frame part.

With this configuration, the tape is substantially prevented from being pulled out of the drum or the reel when the first frame part turns, which is beneficial for prevention of slacking of the tape.

The sheet storage device may include a second reel around which a second tape is wound. The second frame part may form a second tape path extending from the second reel to the drum. The second frame part may move together with the second tape path relative to the first frame part.

The second frame part may support the second reel. The second frame part may move together with the second reel and the second tape path relative to the first frame part.

With this configuration, the second tape is substantially prevented from being pulled out of the drum or the second reel, and therefore, the second tape is substantially prevented from becoming slack.

The second frame part may support the drum.

With this configuration, the drum, the second reel, and the second tape path are all supported by the second frame part. Therefore, when the second frame part moves relative to the first frame part, the shape and length of the second tape path are not or almost not changed.

The drum may be disposed between the reel and the second reel at least in a closed state of the transport path.

This configuration is beneficial for making the sheet storage device more compact.

The sheet storage device may include a movable guide configured to be brought into contact with the tape wound around the drum, and move depending on a change in the magnitude of the diameter of the drum. A winding position where tire tape and the second tape may be wound onto the drum is located between the drum and the reel. The movable guide may be disposed between the winding position and the reel.

With this configuration, a space for accommodating the movable guide does not need to be provided between the drum and the second reel. Such an accommodation space can be saved, and therefore, the diameter of the drum can be proportionately increased. The size and capacity of the sheet storage device can both be increased.

A sheet processing apparatus herein disclosed includes the above sheet storage device.

The sheet processing apparatus may include a housing configured to house the sheet storage device, and a transport member disposed in the housing and coupled to the input and output opening of the sheet storage device, and configured to transport the sheet toward the input and output opening or from the input and output opening. The first frame part and the second frame part may form the input and output opening. A part forming the input and output opening of the first frame part or the second frame part may be linked to the transport member with the first frame part and the second frame part having moved relative to each other to open the transport path.

With this configuration, when a user opens at least a portion of the transport path of the sheet storage device in the case of sheet jam or the like, a sheet is substantially prevented from dropping from the open transport path.

The sheet storage device may have a first pivot shaft configured to allow the first frame part and the second frame part to move relative to each other, and a second pivot shaft configured to allow the sheet storage device to move relative to the transport member.

With this configuration, the transport path can be largely opened in the configuration in which the part forming the input and output opening of the first frame part, or the part forming the input and output opening of the second frame part, is linked to the transport member.

Another sheet storage device disclosed herein includes a reel around which a tape is wound, a drum onto which a sheet is wound together with the tape, an input and output opening through which the sheet is passed, and a frame configured to form at least a portion of a transport path on which the sheet is transported from the input and output opening to the drum. The frame has a first frame part and a second frame part. The first frame part and the second frame part are configured to move relative to each other to switch between a state in which the transport path is formed and a state in which at least a portion of the transport path is open. The first frame part forms at least a portion of a tape path extending from the reel to the drum, and moves together with the tape path relative to the second frame part.

The sheet storage device further includes a drive mechanism disposed extending from the first frame part to the second frame part. The drive mechanism rotates the drum or the reel in a direction in which the tape is wound, in association with the movement of the first frame part relative to the second frame part.

With this configuration, when the first frame part moves relative to the second frame part, the tape is wound onto the drum or the reel. In the sheet storage device, a part for exerting tension on the tape, such as a torsion spring, is not required, resulting in a simpler configuration.

The drive mechanism may have at least a first member supported by the first frame part, and configured to move together with the first frame part relative to the second frame part, and a second member configured to rotate the drum or the reel in a direction in which the tape is wound, in response to the movement of the first member relative to the second frame part.

With this configuration, the drive mechanism can rotate the drum or the reel when the first frame part moves relative to the second frame part.

The reel may be supported by the first frame part or the second frame part. The drum may be supported by the second frame part or the first frame part. The reel and the drum may be coupled together through the drive mechanism.

The first frame part may support the reel, and turn together with the reel and the tape path around the center of rotation of the drum relative to the second frame part. The second frame part may support the drum. The drive mechanism may have a drum gear linked to the drum, a reel gear linked to the reel, and an idle gear engaging with both the drum gear and the reel gear. The idle gear may be the first member, and the idle gear may revolve around the center of rotation of the drum with the idle gear engaging with both the drum gear and the reel gear during the turning of the first frame part relative to the second frame part.

With this configuration, when the first frame part and the second frame part turn relative to each other, the plurality of gears of the drive mechanism are kept linked together to rotate the drum or the reel.

The drive mechanism may have a preventing member configured to prevent rotation of the drum gear and the drum during the turning of the first frame part relative to the second frame part in a direction in which the transport path is opened. During the turning of the first frame part relative to the second frame part in the direction in which the transport path is opened, the idle gear may revolve around the center of rotation of the drum while rotating on an axis thereof, whereby the reel rotates in the winding direction of the tape through the reel gear.

With this configuration, the tape is substantially prevented from becoming slack due to the turning of the reel when at least a portion of the transport path is opened.

The drive mechanism may have a second preventing member configured to prevent rotation of the reel gear and the reel during the turning of the first frame part relative to the second frame part in a direction in which the transport path is opened. During the turning of the first frame part relative to the second frame part in the direction in which the transport path is opened, the idle gear may revolve around the center of rotation of the drum without rotating on an axis thereof, which causes the drum gear to rotate, whereby the drum rotates in the winding direction of the tape.

With this configuration, the tape is substantially prevented from becoming slack due to the rotation of the drum when at least a portion of the transport path is opened.

The reel, the drum, or the reel and the drum, may be supported by the second frame part. The drive mechanism may be coupled to the reel or the drum.

With this configuration, when the first frame part moves relative to the second frame part, the drive mechanism rotates the reel or the drum so that the tape is wound.

The drum may be supported by the second frame part. The drive mechanism may have a drum gear finked to the drum, and a frame gear supported by the first frame part. The frame gear may be the first member. The drum gear may rotate the drum in a direction in which the tape is wound, in response to the movement of the frame gear relative to the second frame part.

The reel may be supported by the second frame part. The drive mechanism may have a reel gear finked to the reel, and a frame gear linked to the first frame part. The frame gear may be the first member. The reel gear may rotate the reel in a direction in which the tape is wound, in response to the movement of the frame gear relative to the second frame part.

The first frame part may turn around a pivot shaft relative to the second frame part. The frame gear may turn around the pivot shaft in association with the turning of the first frame part relative to the second frame part. The drive mechanism may remove linkage between the frame gear and the second member in a state in which the first frame part and the second frame part forms the transport path. During the turning of the first frame part relative to the second frame part, the drive mechanism may link the frame gear and the second member together to rotate the reel or the drum.

With this configuration, the drive mechanism does not have an influence on the rotation of the drum or the reel when the sheet storage device is in use.

DETAILED DESCRIPTION

Embodiments of a sheet storage device and a sheet processing apparatus will now be described in detail with reference to the accompanying drawings. In the description that follows, an example sheet storage device and an example sheet processing apparatus are described.

Figure 1:
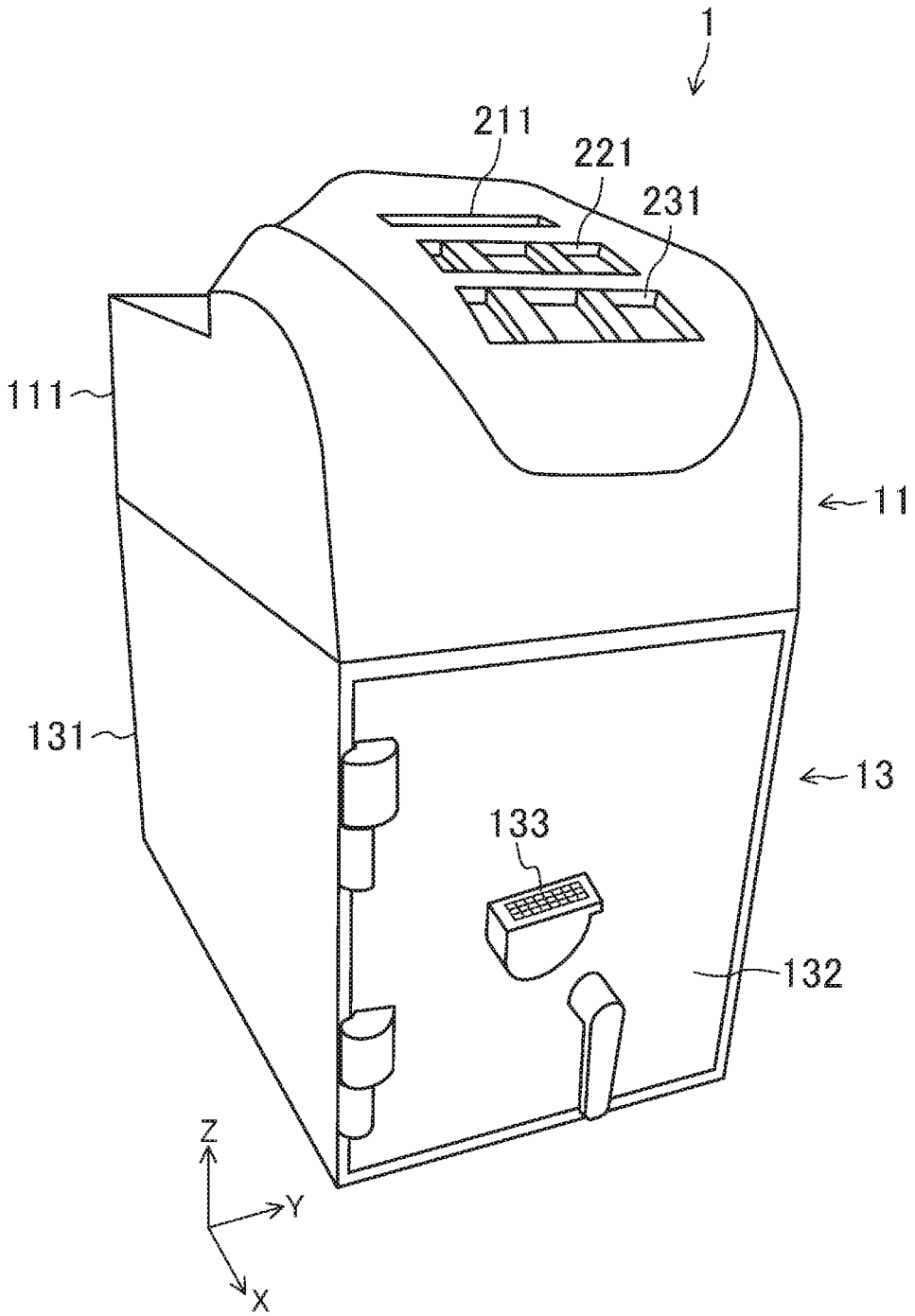
FIG. 1 is a perspective view illustrating an appearance of a banknote processing apparatus.

FIG. 1 shows a banknote processing apparatus 1 as a sheet processing apparatus. The banknote processing apparatus 1, which is installed in, for example, a financial institution, such as a bank, executes various processes including a deposit process and a withdrawal process. Note that the banknote processing apparatus 1 may be installed and used in, for example, the back office of a retail store, in addition to installation in a financial institution.

Overall Configuration of Banknote Processing Apparatus

Figure 2:
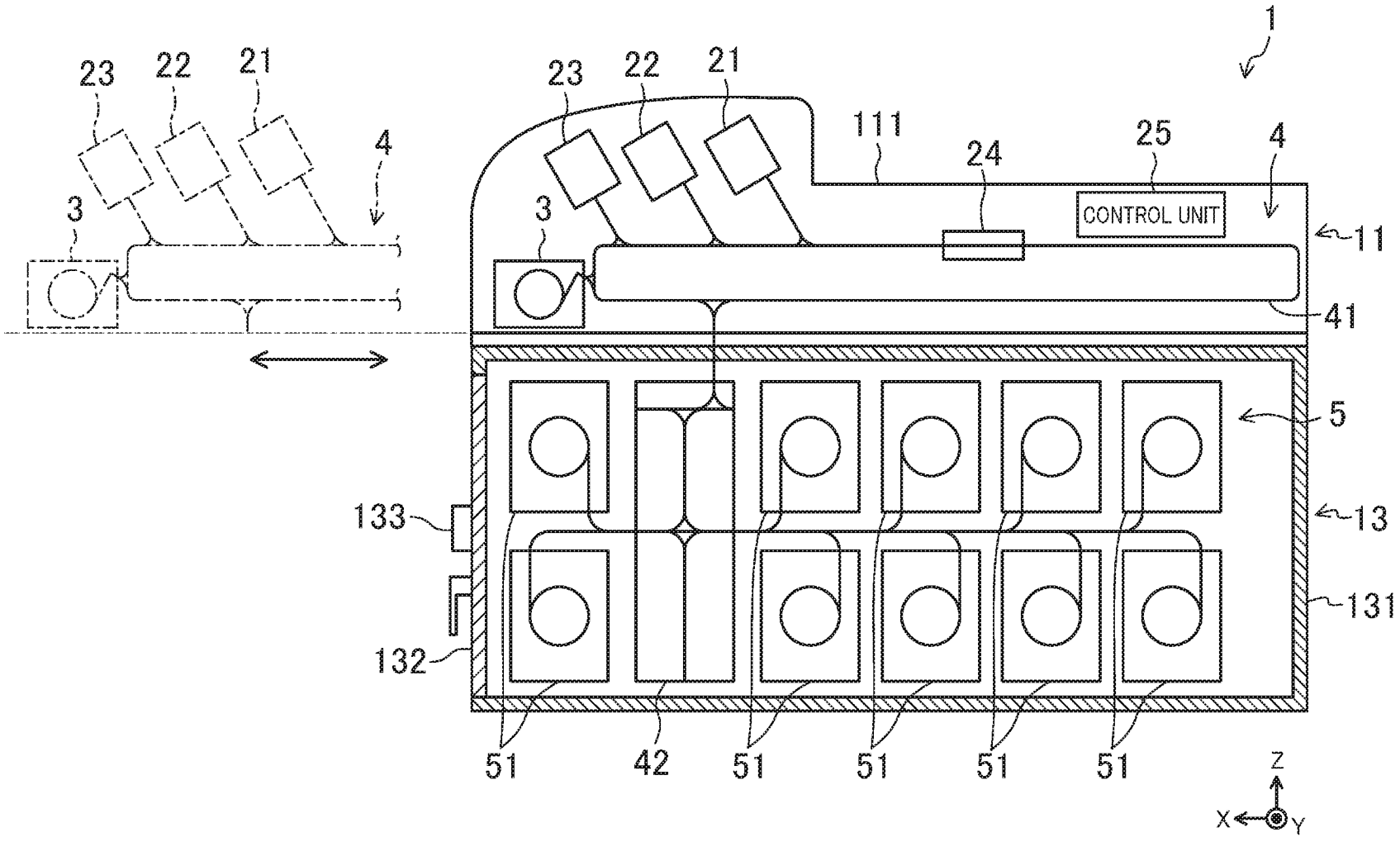
FIG. 2 is a schematic diagram showing an example internal configuration of a banknote processing apparatus.

FIG. 1 shows an example appearance of the banknote processing apparatus 1. FIG. 2 shows an example internal structure of the banknote processing apparatus 1. In the description that follows, for the sake of convenience, as shown in FIG. 1, a direction from the back to front of the banknote processing apparatus 1 is represented by X direction, a direction from left to right that is defined from the point of view of an observer facing the front side of the banknote processing apparatus 1 is represented by Y direction, and a direction from the bottom to top of the banknote processing apparatus 1 is represented by Z direction.

The banknote processing apparatus 1 processes loose banknotes. The banknote processing apparatus 1 has a processing unit 11 located in an upper portion thereof and a safe unit 13 located in a lower portion thereof.

The processing unit U includes a deposit unit 21, a first dispense unit 22, a second withdrawal unit 23, a recognition unit 24, a temporary storage unit 3, a portion of a transport unit 4, and a control unit 25, which are disposed in a housing 111. As indicated by dash-dot lines in FIG. 2, a user can pull, out of the housing 111, the deposit unit 21, the first withdrawal unit 22, the second withdrawal unit 23, the recognition unit 24, the temporary storage unit 3, and a portion of the transport unit 4 by shifting them in the X direction.

The deposit unit 21 is a part into which banknotes are put in, for example, the deposit process. The deposit unit 21 has an inlet 211. The inlet 211 is an opening in an upper surface of the housing 111. The user puts banknotes into the deposit unit 23 through the inlet 211. The deposit unit 21 has a mechanism that feeds banknotes loaded therein into the apparatus one by one.

The first and second withdrawal units 22 and 23 are parts in which banknotes are dispensed in, for example, the withdrawal process. The first and second withdrawal units 22 and 23 can be used for other purposes in addition to the withdrawal process. The first and second withdrawal units 22 and 23 have the same configuration. The first and second withdrawal units 22 and 23 are each configured so that a plurality of banknotes are gathered therein. The first and second withdrawal units 22 and 23 have respective outlets 221 and 231. The outlets 221 and 231 are an opening in the upper surface of the housing 111. The user can take out banknotes gathered in the first withdrawal unit 22 through the outlet 221. The user can take out banknotes gathered in the second withdrawal unit 23 through the outlet 231.

The recognition unit 24 is disposed on a loop transport path 41 described below. The recognition unit 24 recognizes at least the authenticity, denomination, and fitness of each banknote transported on the loop transport path 41.

The temporary storage unit 3 includes a banknote storage device 6. The temporary storage unit 3 can take in and store banknotes therein, and feed out banknotes stored therein. The temporary storage unit 3 temporarily stores banknotes to be deposited, in, for example, the deposit process. When the deposit process is accepted, the temporary storage unit 3 feeds out the stored banknotes. The banknotes led out are stored in a storage unit 5 described below. The temporary storage unit 3 can also be used for other purposes.

The temporary storage unit 3 is located in a front portion of the housing 111. The temporary storage unit 3 is removably disposed in the housing 111. The banknote processing apparatus 1 can operate without the temporary storage unit 3. The banknote storage device 6 included in the temporary storage unit 3 is described in detail below.

The safe unit 13 includes a safe housing 131. In the safe housing 131, the storage unit 5 and a portion of the transport unit 4 are disposed. The safe housing 131 protects the storage unit 5 at a predetermined protection level or higher. The protection level of the safe housing 131 is higher than that of the housing 111.

A door 132 is attached to a front portion of the safe housing 131. A lock unit 133 is attached to the door 132. The user can open the door 132 by entering a preset password into the lock unit 133.

The storage unit 5 has a plurality of tape-type storage units 51. The illustrated banknote processing apparatus 1 has a total of 10 tape-type storage units 51. The tape-type storage units 51 are disposed in the safe housing 131 and aligned in a vertical direction and in a horizontal direction. Note that the number and arrangement of the tape-type storage units 51 are not particularly limited.

Each tape-type storage unit 51 is configured so that banknotes can be taken in and stored therein, and banknotes stored therein can be fed out.

The transport unit 4 has a transport path. The transport unit 4 is configured to transport banknotes, one by one on the transport path with, for example, a longer side of each banknote facing forward and the banknotes spaced apart from each other. Although not shown, the transport unit 4 is configured by a combination of a number of rollers, a plurality of belts, a motor for driving these components, and a plurality of guides.

The transport unit 4 has the loop transport path 41 provided in the housing 111. As described above, the loop transport path 41 passes through the recognition unit 24. The transport unit 4 transports banknotes along the loop transport path 41 clockwise and counterclockwise in FIG. 2.

The deposit unit 21, the first withdrawal unit 22, and the second withdrawal unit 23 are coupled to the loop transport path 41 through coupling paths. The temporary storage unit 3 is also coupled to the loop transport path 41.

Although not shown, a diverter for changing destinations of banknotes is provided between the loop transport path 41, and the deposit unit 21, the first withdrawal unit 22, the second withdrawal unit 23, and the temporary storage unit 3.

The transport unit 4 has a transport module 42 in the safe housing 131. The transport module 42 is removable from the safe housing 131. The transport module 42 has a transport path that links the loop transport path 41 and each tape-type storage unit 51 together. Although not shown, the transport module 42 has a diverter that changes transport destinations of banknotes.

Although not shown, a tracking sensor that detects passage of banknotes is disposed at various portions of the transport path. The transport unit 4 transports banknotes to a predetermined transport destination in response to an instruction from the control unit 25, by controlling each diverter on the basis of detection signals of the tracking sensors.

Operations of the banknote processing apparatus 1 during execution of the deposit process and the withdrawal process will now be briefly described.

Deposit Process

The user puts banknotes to be deposited into the deposit unit 21. The deposit unit 21 feeds the banknotes one by one into the apparatus. The transport unit 4 transports the banknote to the recognition unit 24. The recognition unit 24 recognizes the banknote. After the banknote has been passed through the recognition unit 24, the transport unit 4 transports the banknote through the transport module 42 to one of the plurality of tape-type storage units 51. The tape-type storage unit 51 stores the banknote. If all banknotes that can be deposited have been stored in the tape-type storage units 51, the deposit process is ended.

Note that in the case where the temporary storage unit 3 is used in the deposit process, the transport unit 4 transports banknotes that have been passed through the recognition unit 24, to the temporary storage unit 3. The temporary storage unit 3 stores the banknotes. After the amount of the deposit has been accepted, the temporary storage unit 3 feeds out the stored banknotes. The transport unit 4 transports each of the banknotes fed out by the temporary storage unit 3, to one of the plurality of tape-type storage units 51 through the transport module 42.

Withdrawal Process

The tape-type storage unit 51 feeds out banknotes to be withdrawn in the withdrawal process. The transport unit 4 transports the banknotes fed out by the tape-type storage unit 51, from the transport module 42 through the loop transport path 41 to the recognition unit 24. The recognition unit 24 recognizes the banknotes. The transport unit 4 transports the recognized banknotes to the first withdrawal unit 22 and/or the second withdrawal unit 23. If all banknotes to be withdrawn have been withdrawn to the first withdrawal unit 22 or the second withdrawal unit 23, the withdrawal process is ended.

Example Configuration of Banknote Storage Device

FIGS. 3-6 show an example configuration of the banknote storage device 6. As described above, the banknote storage device 6 is included in the temporary storage unit 3.

Figure 3:
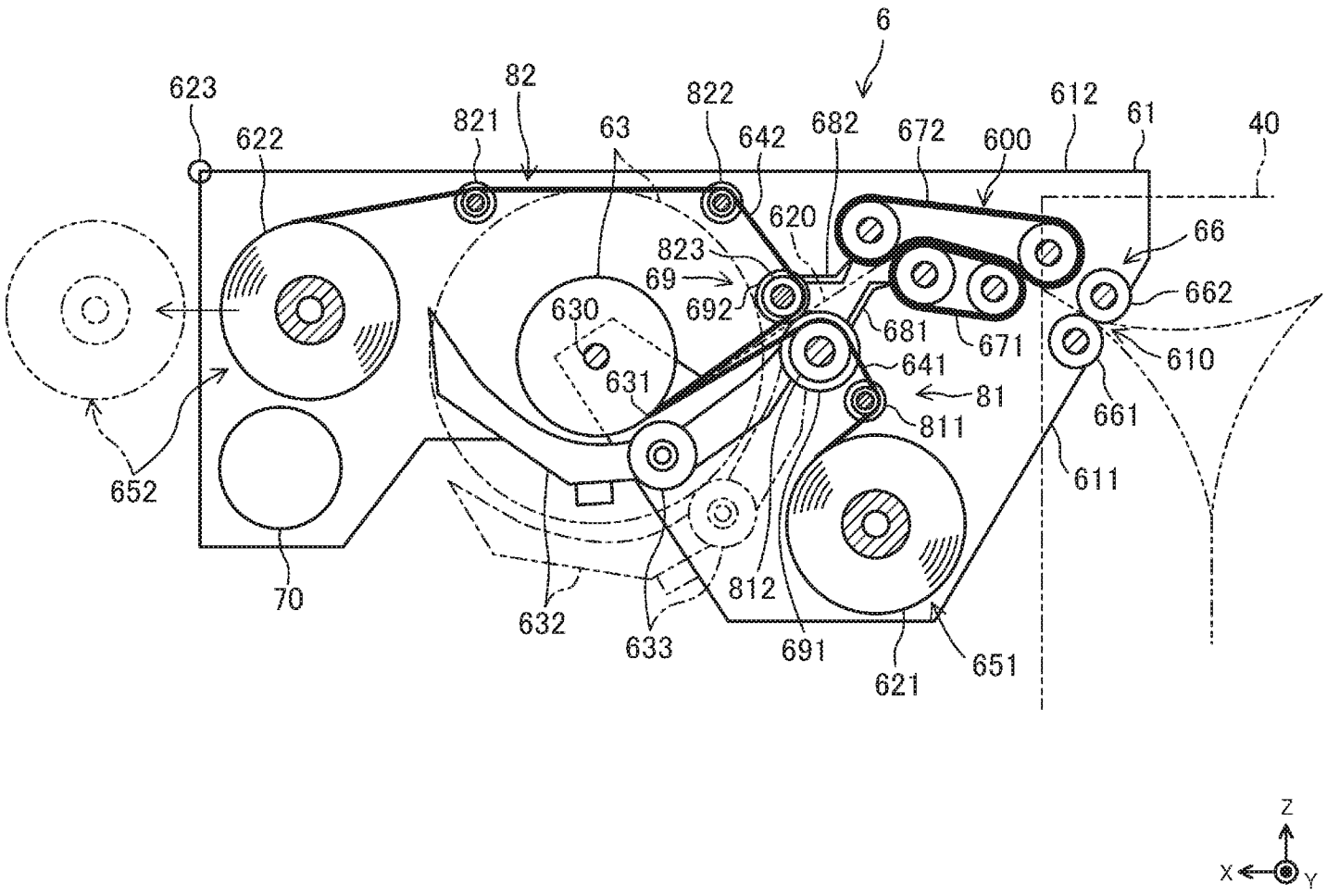
FIG. 3 is a cross-sectional view showing an example internal configuration of a banknote storage device as viewed from a side thereof.
Figure 4:
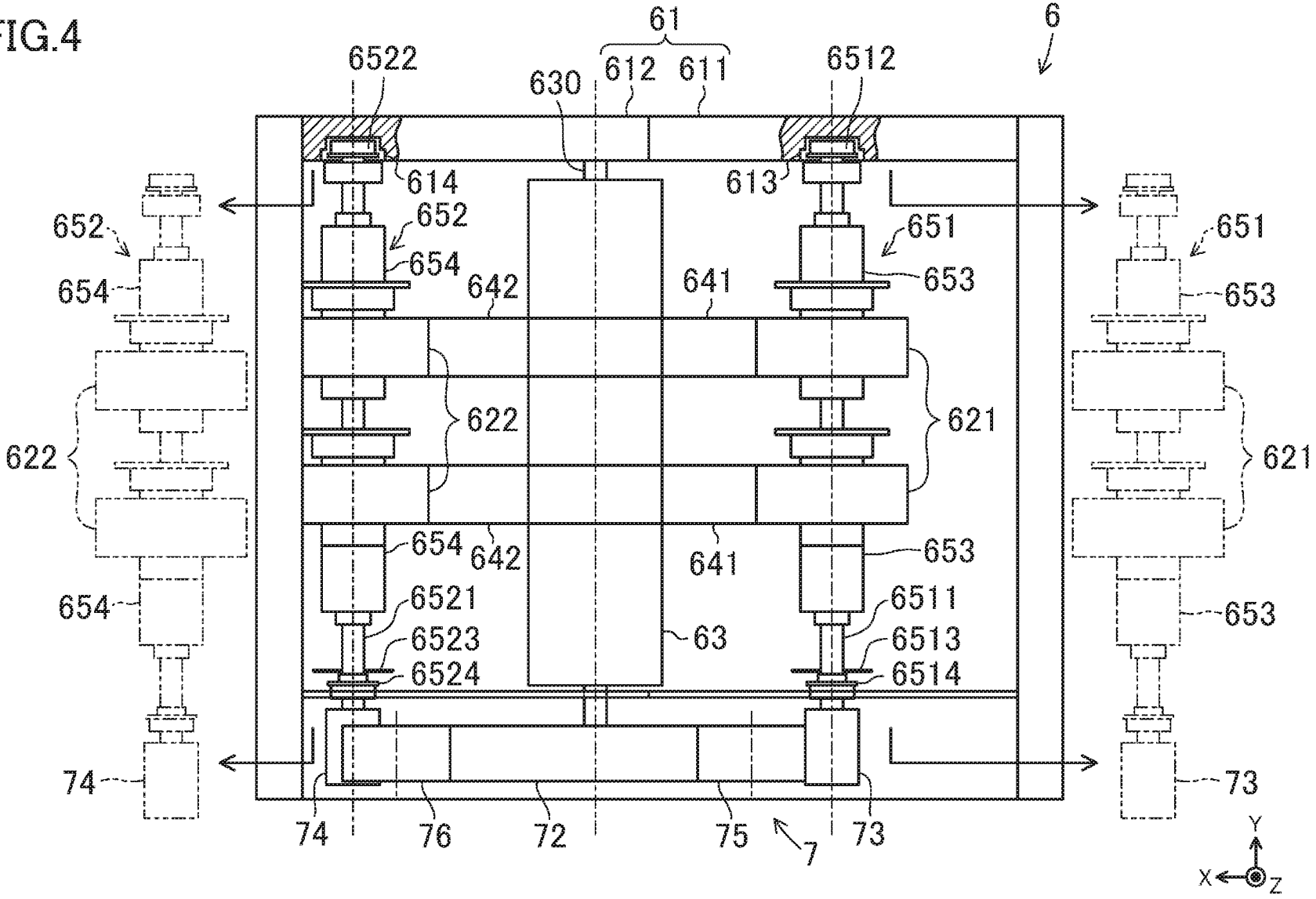
FIG. 4 is a bottom view showing an example configuration of a banknote storage device.

FIG. 3 is a cross-sectional view of the banknote storage device 6 as viewed from a side thereof. FIG. 4 is a bottom view of the banknote storage device 6. In FIG. 3, solid lines indicate the state in which the storage amount of the banknote storage device 6 is zero, i.e. no banknotes are stored in the banknote storage device 6. In FIG. 3, dash-dot lines indicate the state in which tire storage amount of the banknote storage device 6 is maximum.

In FIG. 3, a reference character 40 indicates a transport member. The transport member 40 is disposed in the housing 111, and forms a portion of the above loop transport path 41 and coupling path. An input and output opening 610 through which banknotes are input and output is provided in a side surface (right surface in the example of FIG. 3) of the banknote storage device 6. The transport member 40 is coupled to the input and output opening 610 of the banknote storage device 6. More specifically, the input and output opening 610 is provided with a comb tooth-shaped coupling guide (not shown). In addition, the transport member 40 is provided with a comb tooth-shaped coupling guide (not shown). Specifically, a comb tooth-shaped coupling guide is provided at an end portion of the coupling path extending from the loop transport path 41 to the banknote storage device 6. The comb tooth-shaped portions of the two coupling guides overlap each other, so that the transport member 40 is coupled to the input and output opening 610 of the banknote storage device 6. The transport member 40 transports banknotes toward the input and output opening 610, so that the banknotes pass through the input and output opening 610 and then enter the banknote storage device 6. The transport member 40 also transports banknotes that have been output from the banknote storage device 6 through the input and output opening 610.

The banknote storage device 6 includes a storage mechanism 600, and a frame 61 that accommodates the storage mechanism 600. The storage mechanism 600 is configured so that a banknote 100 (see FIG. 5) sandwiched between two tapes is wound together with the tapes onto the drum 63. The banknote 100 is wound onto the drum 63 with the longer sides of the banknote 100 parallel to the axis of rotation of the drum 63. The storage mechanism 600 has a first reel 621, a second reel 622, and the drum 63. The frame 61 has a first frame part 611 and a second frame part 612.

An end of a first tape 641 is fixed to the first reel 621, and the first tape 641 is wound around the first reel 621. An end of a second tape 642 is fixed to the second reel 622, and the second tape 642 is wound around the second reel 622. The other end of the first tape 641 and the other end of the second tape 642 are each fixed to an outer peripheral surface of the drum 63.

The first reel 621 is located closer to the input and output opening 610 than is the drum 63. The second reel 622 is located further from the input and output opening 610 than is the drum 63. As shown in FIG. 3, in the state in which the first frame part 611 and the second frame part 612 form a transport path 620 described below, the first reel 621 and the second reel 622 are located facing each other with the drum 63 interposed therebetween.

As shown in FIG. 4, there are two of the first reels 621 that are spaced apart from each other in the Y direction. The two first reels 621 and a shaft 6511 are integrated together to form a first reel unit 651. The shaft 6511 supports the two first reels 621 separately, and serves as the center of rotation of the first reels 621. The first reels 621 are supported by the shaft 6511 through, for example, a torque limiter. A first reel gear 73 described below is attached to the base end of the first reel unit 651.

Likewise, there are two of the second reels 622 that are spaced apart from each other in the Y direction. The two second reels 622 and a shaft 6521 are integrated together to form a second reel unit 652. The shaft 6521 supports the two second reels 622 separately, and serves as the center of rotation of the second reels 622. The second reels 622 are supported by the shaft 6521 through, for example, a torque limiter. A second reel described below is attached to the base end of the second reel unit 652.

The first reel unit 651 is supported by the first frame part 611. The two first reels 621 are supported by the first frame part 611. The first reels 621 rotate in the direction in which the first tapes 641 are unwound (clockwise in FIG. 3) and in the direction in which the first tapes 641 are wound (counterclockwise in FIG. 3). The two first reels 621 independently rotate depending on the tension of the first tapes 641.

The second reel unit 652 is supported by the second frame part 612. The two second reels 622 are supported by the second frame part 612. The second reels 622 rotate in the direction in which the second tapes 642 are unwound (clockwise in FIG. 3) and in the direction in which the second tapes 642 are wound (counterclockwise in FIG. 3). The two second reels 622 independently rotate depending on the tension of the second tapes 642.

As shown in FIG. 3, in the state in which the first frame part 611 and the second frame part 612 form a transport path 620 described below, the drum 63 is disposed between the first reel 621 and the second reel 622. A shaft 630 of the drum 63 is supported by the second frame part 612. The center of rotation of the drum 63 extends in the Y direction. The center of rotation of the drum 63, the center of rotation of the first reel 621, and the center of rotation of the second reel 622 are parallel to each other, the drum 63 rotates in the direction in which the banknote 100 and the tapes are wound and in the direction in which the banknote 100 and the tapes are unwound. In the example of FIG. 3, the direction in which the banknote 100 and the tapes are wound onto the drum 63 is the clockwise direction, and the direction in which the banknote 300 and the tapes are unwound is the counterclockwise direction.

The first tape 641 unwound from the first reel 621 is moved along a first tape path 81 to reach the drum 63. The first tape path 81 is formed by a first tape pulley 811 and a second tape pulley 812. The first and second tape pulleys 811 and 812 are both supported by the first frame part 611.

The second tape 642 unwound from the second reel 622 is moved along a second tape path 82 to reach the drum 63. The second tape path 82 is formed by a third tape pulley 821, a fourth rape pulley 822, and a fifth tape pulley 823. The third tape pulley 821, the fourth rape pulley 822, and the fifth tape pulley 823 are all supported by the second frame part 612.

The first tape pulley 811 is located closer to the first reel 621 than is the second tape pulley 812. The second tape pulley 812 is located closer to the drum 63 than is the first tape pulley 811. The second tape pulley 812 is located on the banknote transport path 620. The first tape 641 unwound from the first reel 621 is wrapped around the first tape pulley 811 and the second tape pulley 812 in this order. The first tape 641 wrapped around the second tape pulley 812 is moved along the transport path 620 to reach the drum 63.

The third tape pulley 821 is located closer to the second reel 622 than are the fourth tape pulley 822 and the fifth tape pulley 823. The fourth tape pulley 822 is disposed between the third tape pulley 821 and the fifth tape pulley 823. The fifth tape pulley 823 is located on the transport path 620. The fifth tape pulley 823 and the second tape pulley 812 face each other with the transport path 620 interposed therebetween.

The second tape 642 unwound from the second reel 622 is wrapped around the third tape pulley 821, the fourth tape pulley 822, and the fifth tape pulley 823 in this order. The second tape 642 wrapped around the fifth tape pulley 823 is moved along the transport path 620, facing the first tape 641, to reach the drum 63.

A winding position 631 where the first tape 641 and the second tape 642 are wound onto the drum 63, is located between the drum 63 and the first reel 621. The second tape 642 goes around the drum 63 after having been unwound from the second reel 622 to reach the winding position 631. The first and second tapes 641 and 642 stacking together are wound around the outer peripheral surface of the drum 63. Note that the first tape pulley 811, the second tape pulley 812, the third tape pulley 821, the fourth tape pulley 822, and the fifth tape pulley 823 do not necessarily need to be a pulley, and may be a guide that changes the movement direction of the tape.

As indicated using an imaginary line in FIG. 3, the transport path 620 is formed between the input and output opening 610 and the drum 63. The transport path 620 is formed by an input and output opening roller pair 66, a first belt 671 and a second belt 672, a first guide member 681 and a second guide member 682, and a grip roller pair 69. The banknote 100 is transported along the transport path 620 in a direction from the input and output opening 610 toward the drum 63 or in a direction from the drum 63 toward the input and output opening 610.

The input and output opening roller pair 66 includes a first input and output opening roller 661 and a second input and output opening roller 662. The first input and output opening roller 661 is supported by the first frame part 611, and the second input and output opening roller 662 is supported by the second frame part 612. The input and output opening roller pair 66 feeds the banknote 100 into the banknote storage device 6 through the input and output opening 610, and sends out the banknote 100 from the inside of the banknote storage device 6 through the input and output opening 610. The first input and output opening roller 661 may be supported by the transport member 40.

The first belt 671 is wrapped around two rollers. The first belt 671 is supported by the first frame part 611. The second belt 672 is wrapped around two rollers different from those around which the first belt 671 is wrapped. The second belt 672 is supported by the second frame part 612.

The first belt 671 is moved along the transport path 620 of the banknote 100. The second belt 672 is also moved along the transport path 620. The first belt 671 and the second belt 672 face each other with the banknote 100 sandwiched therebetween in the thickness direction. The first and second belts 671 and 672 transport the banknote 100 from the input and output opening 610 toward the drum 63 or from the drum 63 toward the input and output opening 610.

Figure 5:
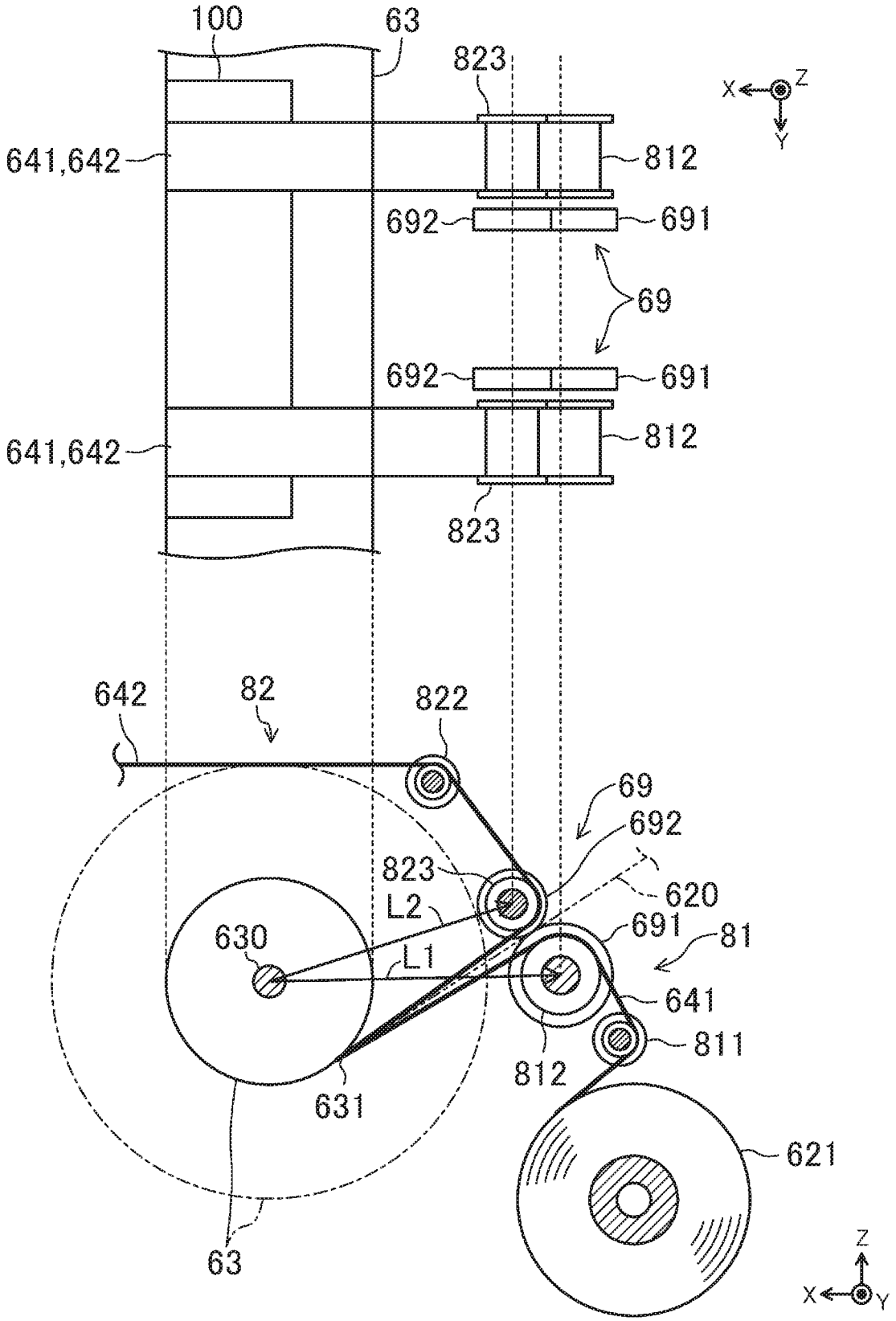
FIG. 5 is a diagram including a plan view (upper diagram) and a side view (lower diagram) showing a configuration at and near a position where a tape is wound around a drum.

FIG. 5 shows a portion where the grip roller pair 69 is disposed near the drum 63. The lower diagram of FIG. 5 shows that portion as viewed from a side thereof. The upper diagram of FIG. 5 shows that portion as viewed from above. There are two of the grip roller pairs 69 that are spaced apart from each other in the Y direction. The two grip roller pairs 69 each sandwich a predetermined portion in the longer side orientation of the banknote 100, and transport the banknote 100 from the input and output opening 610 toward the drum 63 or from the drum 63 toward the input and output opening 610.

More specifically, the grip roller pair 69 includes a first grip roller 691 and a second grip roller 692. The first grip roller 691 and the second grip roller 692 face each other.

The first grip roller 691 and the second tape pulley 812 are coaxially disposed. The first grip roller 691 is supported by the first frame part 611. The first grip roller 691 has a greater diameter than that of the second tape pulley 812. The first grip roller 691 is also located closer to the center of the drum 63 than is the second tape pulley 812 in the direction in which the axis of the drum 63 extends.

The second grip roller 692 and the fifth tape pulley 823 are coaxially disposed. The second grip roller 692 is supported by the second frame part 612. The second grip roller 692 has a greater diameter than that of the fifth tape pulley 823. The second grip roller 692 is also located closer to the center of the drum 63 than is the fifth tape pulley 823 in the direction in which the axis of the drum 63 extends.

The first grip roller 691 is different from the second grip roller 692 in that a distance L1 between the center of rotation of the drum 63 and the first grip roller 691 is longer than a distance L2 between the center of rotation of the drum 63 and the second grip roller 692. In addition, the diameter of the second grip roller 692 is smaller than that of the first grip roller 691. Note that the diameter of the fifth tape pulley 823 is smaller than that of the second tape pulley 812.

Here, dash-dot line circle shown in FIG. 5 indicates the position of the outer periphery of the drum 63 in the state in which banknotes 100 have been wound onto the drum 63 such that the diameter of the drum 63 is maximum. Note that as used herein, the magnitude of the diameter of the drum 63 means the outermost diameter of the drum 63 with the first and second tapes 641 and 642 and banknotes 100 wound therearound.

The grip roller pair 69 has the function of first sandwiching the banknote 100 unwound from the drum 63 and transporting the banknote 100. As described above, the banknote 100 is wound onto the drum 63 with the longer side of the banknote 100 parallel to the axis of rotation of the drum 63. A space between the drum 63 and the grip roller pair 69 is determined, depending on the length of the shorter side of the banknote 100 that is to be wound onto the drum 63. Specifically, a space between the winding position 631 that occurs when the magnitude of the diameter of the drum 63 is minimum, and the grip position of the grip roller pair 69 is smaller than the length of the shorter side of the banknote 100.

Meanwhile, the storage amount of the banknote storage device 6 is limited to the range in which the outermost diameter of the drum 63 does not obstruct the grip roller pair 69. In order to increase the storage amount of the banknote storage device 6, it is effective to increase the space between the drum 63 and the grip roller pair 69. However, as described above, the space between the drum 63 and the grip roller pair 69 is determined by the length of the short side of the banknote 100.

As can be seen from the positional relationship between the dash-dot line circle shown in the lower diagram of FIG. 5 and the second grip roller 692, if the diameter of the second grip roller 692, which is closer to the center of rotation of the drum 63, is smaller than that of the first grip roller 691, the diameter of the drum 63 can be increased without an increase in the space between the drum 63 and the grip roller pair 69. That is, the above configuration can increase the storage amount of the banknote storage device 6.

In addition, the first grip roller 691 is located at a position in the Y direction that is different from that of the second tape pulley 812 that guides the first tape 641, and has a greater diameter than that of the second tape pulley 812. The second grip roller 692 is located at a position in the Y direction that is different from that of the fifth tape pulley 823 that guides the second tape 642, and has a greater diameter than that of the fifth tape pulley 823. The grip roller pair 69 is located closer to the center of the drum 63 than are the first and second tapes 641 and 642 in the axial direction of the drum 63. Specifically, the two first grip rollers 691 are disposed between the two second tape pulleys 812. The two second grip rollers 692 are disposed between the two fifth tape pulleys 823.

The above configuration prevents the grip roller pair 69 from being brought into contact with the first and second tapes 641 and 642. Damage to the surfaces of the first and second tapes 641 and 642 is substantially prevented, resulting in an increase in the life of the first and second tapes 641 and 642.

Referring back to FIG. 3, the first guide member 681 is disposed between the first belt 671 and the first grip roller 691. The second guide member 682 is disposed between the second belt 672 and the second grip roller 692. The first and second guide members 681 and 682 guide the banknote 100 when the banknote 100 being transported in a direction from the drum 63 toward the input and output opening 610 is released from the sandwiched state by the grip roller pair 69. The first and second guide members 681 and 682 also guide the banknote 100 when the banknote 100 being transported in a direction from the input and output opening 610 toward the drum 63 is released from the sandwiched state by the first and second belts 671 and 672. This portion is where the banknote 100 being transported between the drum 63 and the input and output opening 610 is likely to get jammed.

The banknote storage device 6 has a movable guide 632. The movable guide 632 is disposed between the drum 63 and the first reel 621. The base end of the movable guide 632 is pivotably supported by the center of rotation of the first grip roller 691. The movable guide 632 is configured to rotate around the center of rotation of the first grip roller 691 (see a solid line and a dash-dot line in FIG. 3).

The movable guide 632 is pressed by a pressing member (e.g., a spring) (not shown) clockwise in FIG. 3. The movable guide 632 turns clockwise and counterclockwise, depending on the magnitude of the diameter of the drum 63.

A pressing roller 633 is attached to a middle portion of the movable guide 632. The pressing roller 633 is brought into contact with the first tape 641, which is located at an outer position in the radial direction, of the first and second tapes 641 and 642 wound around the drum 63. The pressing roller 633 presses the first and second tapes 641 and 642.

Because the movable guide 632 is disposed between the drum 63 and the first reel 621, a space for accommodating the movable guide 632 does not need to be provided between the drum 63 and the second reel 622. Such an accommodation space can be saved, and therefore, the diameter of the drum 63 can be proportionately increased. Alternatively, because the accommodation space can be saved, the second tape path 82 can be located proportionately closer to the drum 63.

As indicated by a dash-dot line in FIG. 3, when the diameter of the drum 63 is great, the second tape 642 being moved on the second tape path 82 may be in contact with the outer peripheral surface of the drum 63. Note that when the drum 63 rotates in the tape winding direction (clockwise in FIG. 3), the second tape 642 is unwound from the second reel 622 and is brought into contact with the drum 63. The movement direction of the second tape 642 is the same as the winding direction of the drum 63 (the direction from left to right in the drawing sheet of FIG. 3). Conversely, when the drum 63 rotates in the tape unwinding direction (counterclockwise in FIG. 3), the second tape 642 being in contact with the drum 63 is to be wound onto the second reels 622. The movement direction of the second tape 642 is the same as the unwinding direction of the drum 63 (the direction from right to left in the drawing sheet of FIG. 3). Even when the second tape 642 is in contact with the outer peripheral surface of the drum 63, a malfunction does not occur.

e banknote storage device 6 has a total of four tapes, i.e. the two first tapes 641 unwound from the two first reels 621, and the two second tapes 642 unwound from the two second reels 622. The first tapes 641 and the second tapes 642 sandwich portions near both ends in the longer side orientation of the banknote 100 being transported along the transport path 620, in the thickness direction of the banknote 100. The banknote 100 sandwiched between the first and second tapes 641 and 642 is wound together with the first and second tapes 641 and 642 onto the drum 63.

In the banknote storage device 6, the banknote 100 and the first and second tapes 641 and 642 are wound onto the drum 63 with the banknote 100 sandwiched between the first and second tapes 641 and 642 stacking together, and therefore, the banknote 100 can be stably wound around the drum 63. The storage configuration employing the four tapes can stably store and feed out the banknote 100 even when the banknote 100 has a break or cut.

Rotation Mechanism of Drum and Reels

The banknote storage device 6 has a gear linkage mechanism 7 that rotates the drum 63 and the first and second reels 621 and 622. In order to wind and unwind the banknote 100 onto and from the drum 63, the gear linkage mechanism 7 rotates the drum 63 and the first and second reels 621 and 622 in synchronization with each other. As a result, the gear linkage mechanism 7 can wind and unwind the first and second tapes 641 and 642 onto and from the drum 63 with a predetermined tension exerted on the first and second tapes 641 and 642. As described below, the gear linkage mechanism 7 is an example of a drive mechanism.

Figure 6:
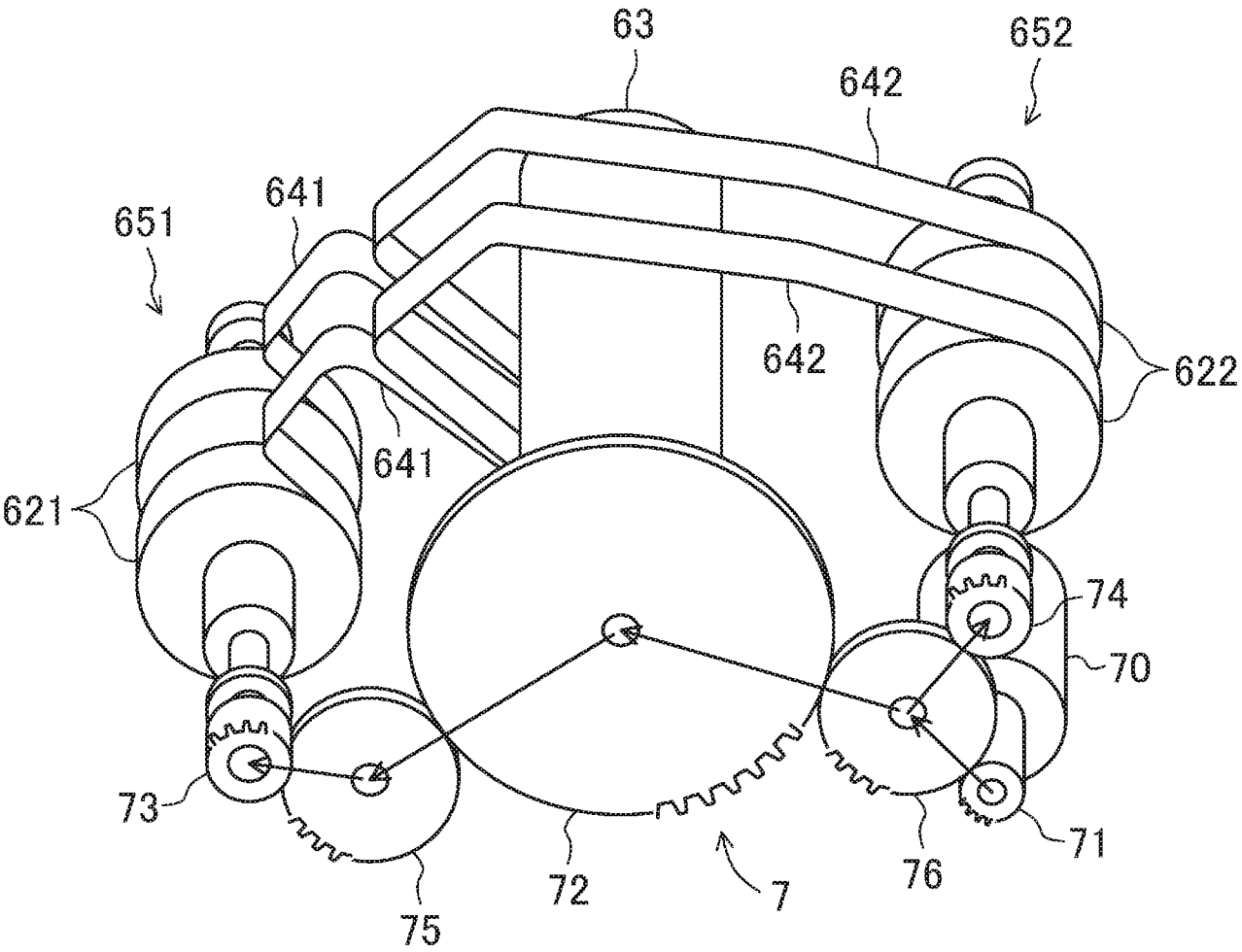
FIG. 6 is a perspective view showing an example configuration of a gear linkage mechanism in a banknote storage device.

FIG. 6 shows an example configuration of the gear linkage mechanism 7 of the banknote storage device 6. In FIG. 6, for easy understanding of the configuration of the gear linkage mechanism 7, only a portion of the teeth of each gear included in the gear linkage mechanism 7 is shown. Note that FIG. 6 corresponds to the configuration of the banknote storage device 6 of FIG. 3 as viewed in the direction opposite to the Y direction. Therefore, the horizontal positions of the first reel unit 651 and the second reel unit 652 of FIG. 6 are reverse compared to the first reel unit 651 and the second reel unit 652 of FIG. 3, i.e. in FIG. 6, the first reel unit 651 is on the left side, and the second reel unit 652 is on the right side.

The gear linkage mechanism 7 has an electric motor 70. The gear linkage mechanism 7 transmits the rotary force of the electric motor 70 to each of the drum 63 and the first and second reels 621 and 622. As shown in FIG. 3, the electric motor 70 is supported by the second frame part 612.

Figure 8:
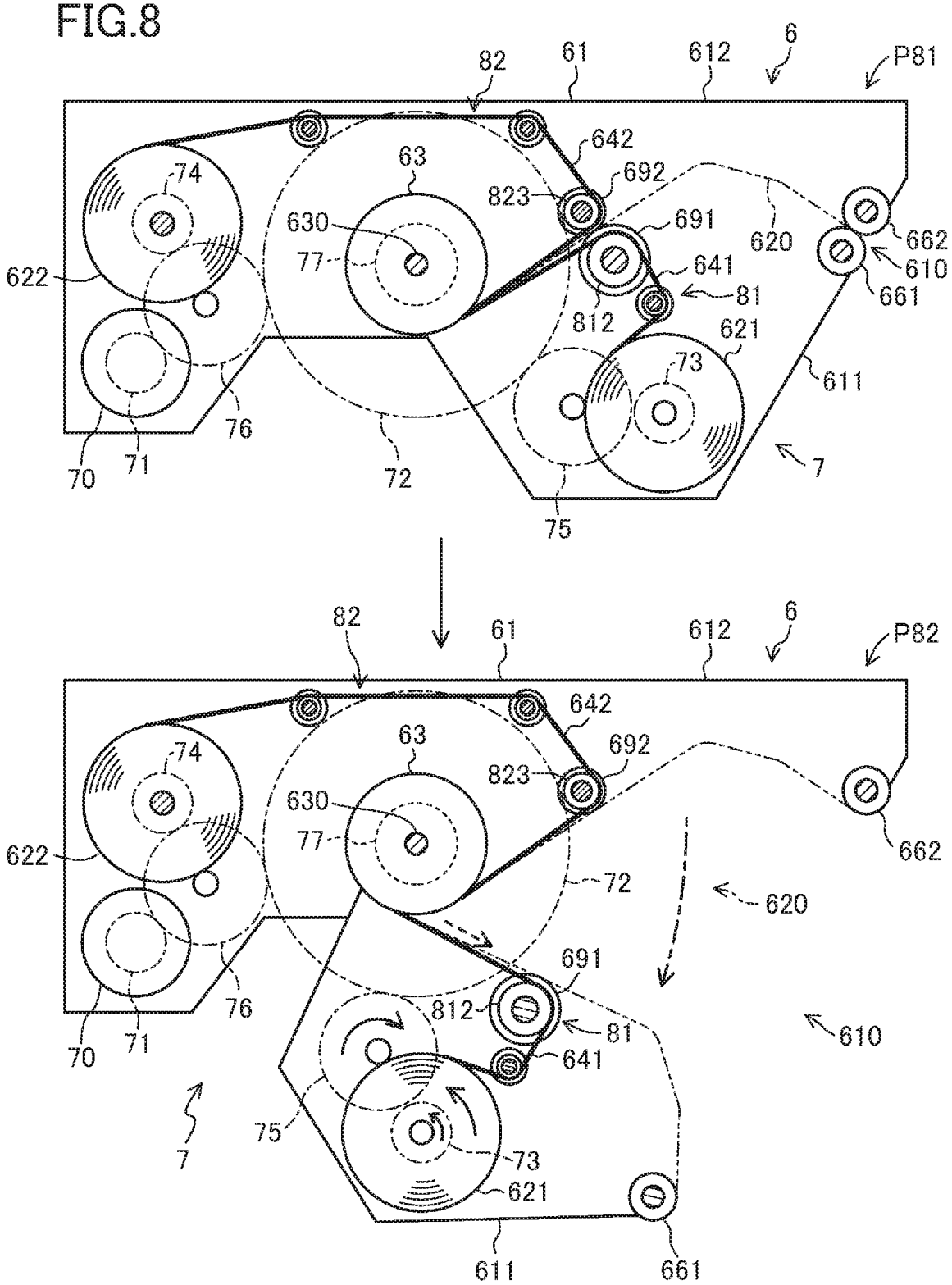
FIG. 8 is a transition diagram showing rotated states of a drum and a reel that occur when a transport path of a banknote storage device is opened.
Figure 9:
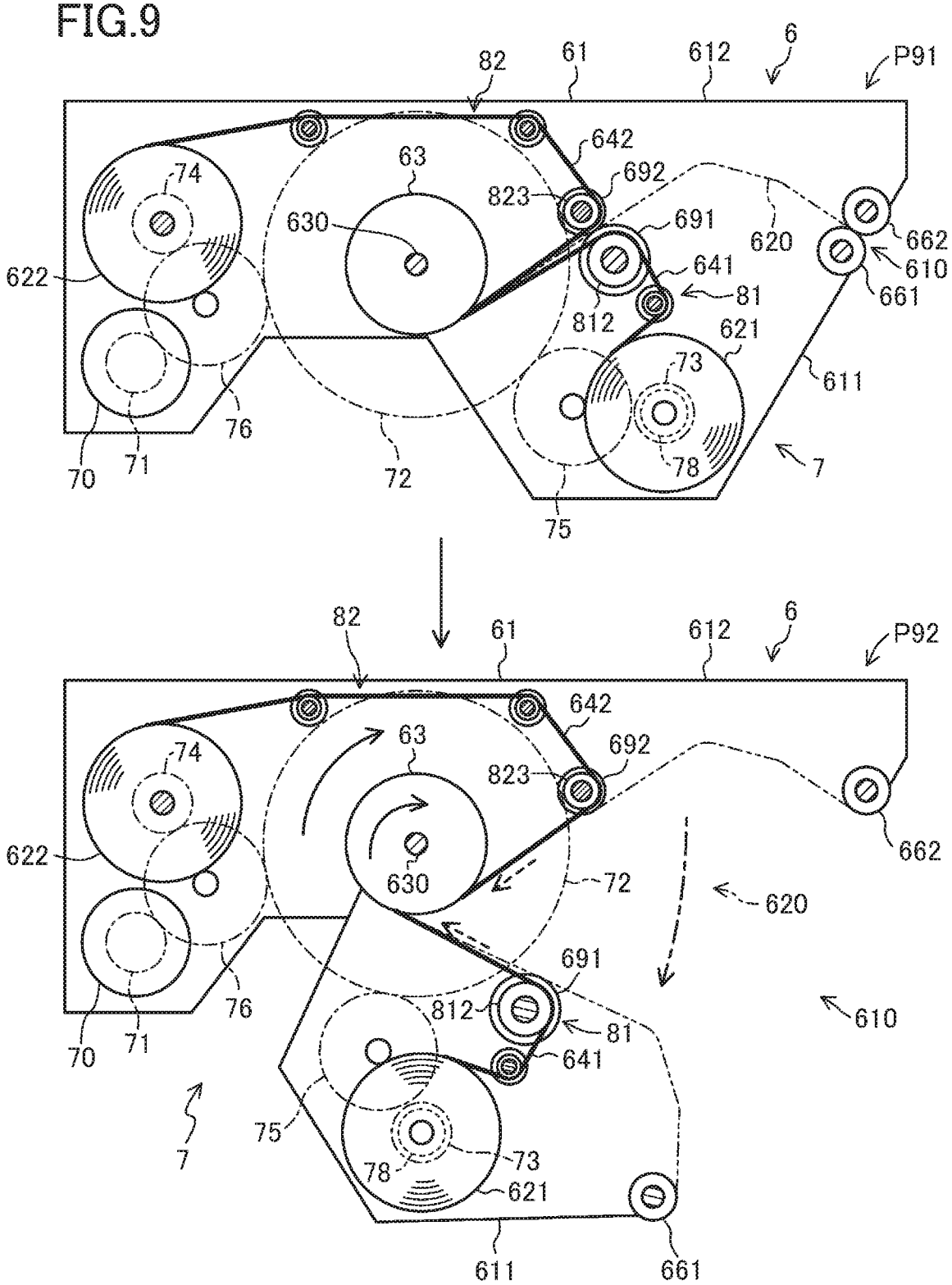
FIG. 9 is a transition diagram showing rotated states of a drum and a reel that occur when a transport path of a banknote storage device is opened, in a configuration different from that of FIG. 8.

The gear linkage mechanism 7 has a motor gear 71, a drum gear 72, a first reel gear 73, a second reel gear 74, a first idle gear 75, and a second idle gear 76. The motor gear 71 is attached to the output shaft of the electric motor 70. The drum gear 72 is attached to the drum 63. The first reel gear 73 is attached to the first reels 621. The second reel gear 74 is attached to the second reels 622. The first idle gear 75 is disposed between the drum gear 72 and the first reel gear 73. The second idle gear 76 is disposed between the drum gear 72 and the second reel gear 74. As shown in FIG. 8 or 9, the first reel gear 73 and the first idle gear 75 are each supported by the first frame part 611. The motor gear 71, the drum gear 72, the second reel gear 74, and the second idle gear 76 are each supported by the second frame part 612. As described below, the first idle gear 75 is an example of a first member that is supported by the first frame part 611, and moves together with the first frame part 611 relative to the second frame part 612. The first reel gear 73 is an example of a second member that rotates the first reels 621 in the direction in which the tape is wound onto the first reels 621, in association with the movement of the first idle gear 75, which is the first member, relative to the second frame part 612.

The center of rotation the drum gear 72 is coincident with the center of rotation of the drum 63. In addition, the center of rotation of the first reel gear 73 is coincident with the center of rotation of the first reels 621, and the center of rotation of the second reel gear 74 is coincident with the center of rotation of the second reels 622.

The motor gear 71 engages with the second idle gear 76. The second idle gear 76 is surrounded by the motor gear 71, the drum gear 72, and the second reel gear 74, and engages with each of the motor gear 71, the drum gear 72, and the second reel gear 74. The diameter of the motor gear 71 is smaller than that of the second idle gear 76. The diameter of the second reel gear 74 is smaller than that of the second idle gear 76. The diameter of the drum gear 72 is greater than that of the second idle gear 76.

As indicated by arrows in FIG. 6, the rotary force of the electric motor 70 is transmitted to the drum gear 72 through the motor gear 71 and the second idle gear 76. The rotary force of the electric motor 70 is also transmitted to the second reel gear 74 through the motor gear 71 and the second idle gear 76. The number of gears provided between the electric motor 70 and the drum 63 is equal to the number of gears provided between the electric motor 70 and the second reels 622.

Gear linkage mechanisms typically have a play (backlash) between gears. For example, if a gear linkage mechanism is configured so that a drum gear and a reel gear are linked together, and the rotary force of an electric motor is transmitted from the drum gear to the reel gear, the number of gears provided between the electric motor and the reel is greater than the number of gears provided between the electric motor and the drum. In such a gear linkage mechanism, the play amount of the gears between the electric motor and the drum is not equal to the play amount of the gears between the electric motor and the reel. There is a time lag between the start of rotation of the drum by the rotation of the electric motor, and the start of rotation of the reel by the rotation of the electric motor. If the timing of rotation of the drum is no coincident with the timing of rotation of the reel, the tape has a slack tension.

In contrast to this, in the case where the number of gears provided between the electric motor 70 and the drum 63 is equal to the number of gears provided between the electric motor 70 and the second reels 622, the play amount of the gears between the electric motor 70 and the drum 63 is equal to the play amount of the gears between the electric motor 70 and the second reels 622. In the gear linkage mechanism 7, the timing of the start of rotation of the drum 63 is coincident with the timing of the start of rotation of the second reels 622. When the banknote 100 is wound onto the drum 63 and when the banknote 100 is unwound from the drum 63, the tension of the second tapes 642 is substantially prevented from becoming slack. When the banknote 100 and the first and second tapes 641 and 642 have been wound onto the drum 63 with the banknote 100 sandwiched between the first and second tapes 641 and 642, the second tapes 642 are located further inside in the radial direction than are the banknote 100 and the first tapes 641. Therefore, the tension of the second tapes 642 which are closer to the drum 63 is substantially prevented from becoming slack. This configuration has the advantage that a pressing member (e.g. a torsion spring) for exerting tension on the tapes is not required.

Note that the rotary force of the electric motor 70 is transmitted to the first reels 621 through the motor gear 71, the second idle gear 76, the drum gear 72, the first idle gear 75, and the first reel gear 73. The diameter of the first reel gear 73 is smaller than that of the first idle gear 75. The diameter of the drum gear 72 is greater than that of the first idle gear 75. The first idle gear 75 and the second idle gear 76 have the same diameter. The first reel gear 73 and the second reel gear 74 have the same diameter. The first reels 621 and the second reels 622 rotate at the same speed.

Alternatively, unlike the above configuration, the electric motor 70 may be disposed near the first reels 621, and the motor gear 71 may engage with the first idle gear 75. In that case, the rotary force of the electric motor 70 is transmitted to the drum gear 72 through the motor gear 71 and the first idle gear 75. In addition, the rotary force of the electric motor 70 is transmitted to the first reel gear 73 through the motor gear 71 and the first idle gear 75. The number of gears provided between the electric motor 70 and the drum 63 is equal to the number of gears provided between the electric motor 70 and the first reels 621. As a result, when the banknote 100 is wound onto the drum 63 and when the banknote 100 is unwound from the drum 63, the tension of the first tape 641 is substantially prevented from becoming slack. When the banknote 100 and the first and second tapes 641 and 642 have been wound onto the drum 63 with the banknote 100 sandwiched between the first and second tapes 641 and 642, the first tapes 641 are, located radially outward of the banknote 100 and the second tapes 642. Because the tension of the first tapes 641 located at an outer position is substantially prevented from becoming slack, the banknote 100 and the second tapes 642 located further inside than are the first tapes 641 can be more tightly wound.

Structure for Opening and Closing Transport Path

The banknote storage device 6 is configured so that the transport path 620 can be opened. If, for example, the banknote 100 is jammed in the banknote storage device 6, the user can easily remove the banknote 100 from the banknote storage device 6 by pulling the banknote storage device 6 out of the banknote processing apparatus 1 as indicated by the dash-dot lines in FIG. 2, and thereby opening the transport path 620. The user can easily maintain the banknote storage device 6.

Figure 7:
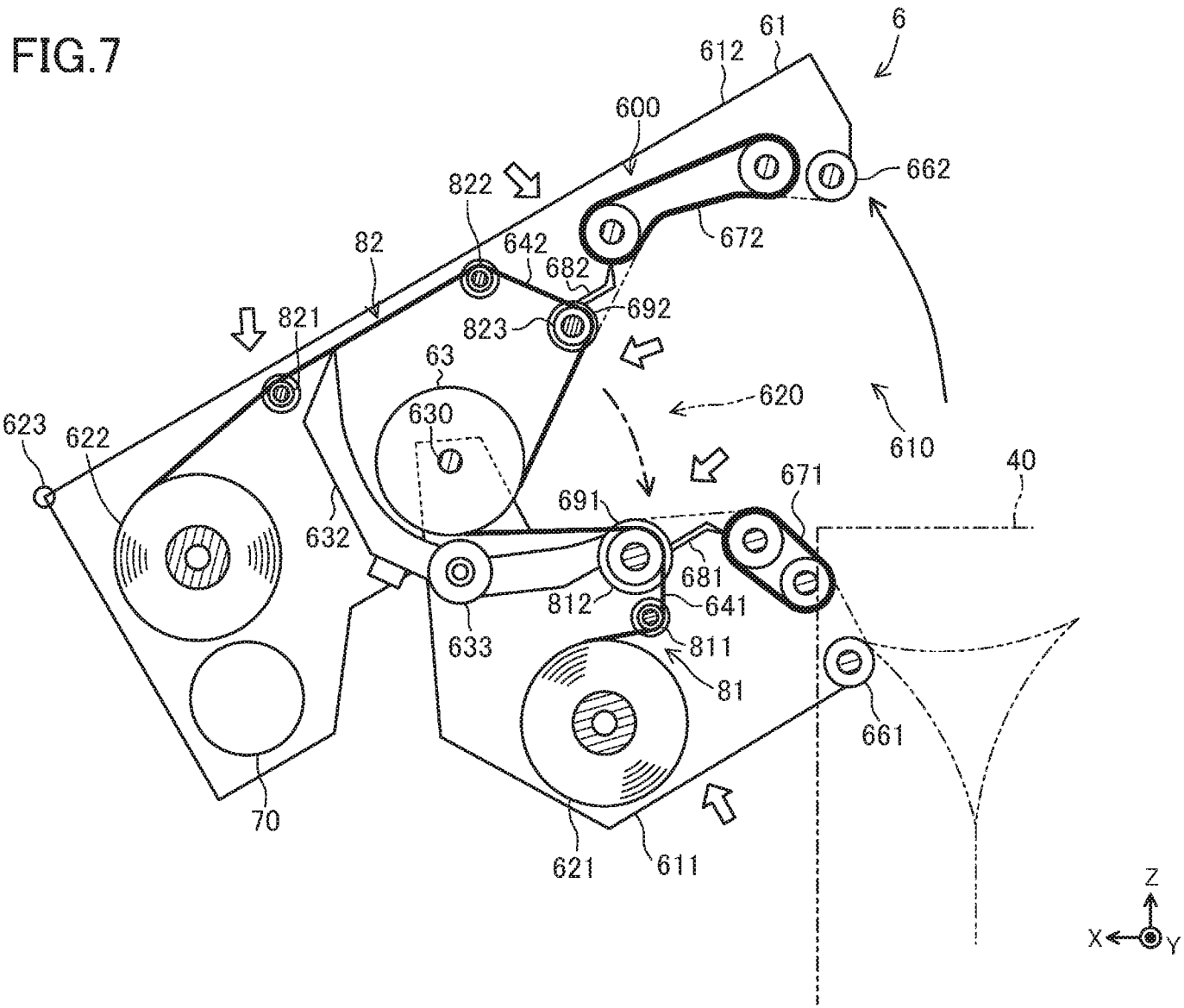
FIG. 7 is a diagram showing a state in which a transport path of a banknote storage device is open, corresponding to FIG. 3.

In the banknote storage device 6, the first and second frame parts 611 and 612, which form the transport path 620, are configured to move relative to each other. The first and second frame parts 611 and 612, when forming the transport path 620 of FIG. 3, are disposed facing each other in the Z direction. The first frame part 611 is pivotably supported by the second frame part 612 at the position of the shaft 630, which serves as a first pivot shaft. As shown in FIG. 7, the first frame part 611 can turn around the center of rotation of the drum 63, relative to the second frame part 612.

As described above, the input and output opening 610 of the banknote storage device 6 is coupled to the transport member 40. The input and output opening roller pair 66 forms the input and output opening 610. The first input and output opening roller 661 of the input and output opening roller pair 66 is attached to the first frame part 611. The first input and output opening roller 661 is removably attached to the transport member 40. Note that, as described above, the first input and output opening roller 661 may be supported by transport member 40.

Although the detailed configuration of the second frame part 612 of the banknote storage device 6 is not shown, the second frame part 612 is pivotally attached to the banknote processing apparatus 1 at the position of a second pivot shaft 623. The second pivot shaft 623 is supported by the banknote processing apparatus 1. The second pivot shaft 623 is located at an opposite side portion of the second frame part 612 from the input and output opening 610. In the state in which the first and second frame parts 611 and 612 forms the transport path 620 the shaft 630, which serves as the first pivot shaft, is located between the second pivot shaft 623 and the input and output opening 610.

The transport path 620 can be opened with the banknote storage device 6 remaining attached to the banknote processing apparatus 1. As indicated by a solid line arrow in FIG. 7, the first input and output opening roller 661 of the first frame part 611 is disposed so that when the second frame part 612 turns upward around the second pivot shaft 623, the position of the first input and output opening roller 661 of the first frame part 611 relative to the transport member 40 is not significantly changed. As indicated by a dash-dot line arrow in FIG. 7 the first frame part 611 turns downward around the center of rotation of the drum 63 relative to the second frame part 612. When the first and second frame parts 611 and 612 turn relative to each other, the first and second input and output opening rollers 661 and 662 of the input and output opening roller pair 66 are separated from each other, the first and second belts 671 and 672 are separated from each other, the first and second guide members 681 and 682 are separated from each other, and the first and second grip rollers 691 and 692 of the grip roller pair 69 are separated from each other. As a result, at least a portion of the transport path 620 formed between the first and second frame parts 611 and 612, and the input and output opening 610, are both opened. The user can easily remove the banknote 100 jammed on the transport path 620 or other portions. Note that in the example configuration of FIG. 7, the entire transport path 620 is opened.

When the transport path 620 is open, the first input and output opening roller 661 of the first frame part 611 is linked to the transport member 40. More specifically, as described above, a comb tooth-shaped coupling guide is provided near the first input and output opening roller 661 of the first frame part 611. In addition, the transport member 40 is provided with a comb tooth-shaped coupling guide. In the state in which the first frame part 611 and the transport member 40 are linked together, the comb tooth-shaped portion of the coupling guide of the first frame part 611 and the comb tooth-shaped portion of the coupling guide of the transport member 40 overlap (interlock). When the transport path 620 is opened, the positron of the first input and output opening roller 661 relative to the transport member 40 is slightly changed, and the state in which the comb tooth-shaped portion of the coupling guide of the first frame part 611 and the comb tooth-shaped portion of the coupling guide of the transport member 40 overlap, is maintained. As a result, the banknote 100 left on the transport path 620 is substantially prevented from dropping from the transport path 620. When the user opens the transport path 620 the banknote 100 present in the banknote storage device 6 is substantially prevented from being lost. The occurrence of an incorrect calculation caused by the user's error correction in the banknote processing apparatus 1 can be substantially prevented.

A configuration of the banknote storage device 6 involved with the opening of the transport path 620 will be described in greater detail. When the first frame part 611 turns relative to the second frame part 612, the first reel 621 and the first tape path 81, which are supported by the first frame part 611, turn together with the first frame part 611 relative to the second frame part 612.

The first frame part 611 turns around the center of rotation of the drum 63 and therefore, the first reel 621 and the first tape path 81 also turn around the center of rotation of the drum 63. As a result, the shape and length of the first tape path 81 extending from the first reel 621 to the drum 63 are not or almost not changed. The first tape 641 is substantially prevented from being pulled, out of the drum 63 or the first reel 621. In other words, the first tape 641 is substantially prevented from becoming slack due to the opening of the transport path 620. In the banknote storage device 6, a part for substantially preventing slacking of the first tape 641, such as a torsion spring, is not required, resulting in a simpler configuration of the banknote storage device 6.

Note that the second reel 622 and the second tape path 82 are supported together with the drum 63 by the second frame part 612. Even when the transport path 620 is open, the shape and length of the second tape path 82 extending from the second reels 622 to the drum 63 are not or almost not changed. Therefore, the second tape 642 is substantially prevented from becoming slack due to the opening of the transport path 620.

In order to close the transport path 620, having been open in the banknote storage device 6, the second frame part 612 is turned downward around the second pivot shaft 623. The first frame part 611 turns relatively upward around the center of rotation of the drum 63. As a result, the first and second input and output opening rollers 661 and 662 of the input and output opening roller pair 66 approach each other, the first and second belts 671 and 672 approach each other, the first and second guide members 681 and 682 approach each other, and the first and second grip rollers 691 and 692 of the grip roller pair 69 approach each other. As a result, the transport path 620 and the input and output opening 610 are formed between the first and second frame parts 611 and 612.

Thus, the banknote storage device 6 as an example sheet storage device includes the first reel 621 around which the first tape 641 is wound, the drum 63 onto which the banknote 100 is wound together with the first tape 641, the input and cutout opening 610 through which the banknote 100 is passed, and the frame 61 that forms at least a portion of the transport path 620 on which the banknote 100 is transported from the input and output opening 610 to the drum 63. The frame 61 has the first and second frame parts 611 and 612. The first and second frame parts 611 and 612 are configured to move relative to each other to switch between the state in which the transport path 620 is formed and the state in which at least a portion of the transport path 620 is open. The first frame part 611 supports the first reel 621, and forms the first tape path 81 extending from the first reels 621 to the drum 63. The first frame part 611 moves together with the first reel 621 and the first tape path 81 relative to the second frame part 612.

Tape Winding Configuration

The banknote storage device 6 is configured to maintain the linkage of the gears in the gear linkage mechanism 7 when the transport path 620 is being opened. Specifically, the first idle gear 5, which is supported by the first frame part 611, turns around the center of rotation of the drum 63 with the drum gear 72 and the first reel gear 73 engaging with each other.

The banknote storage device 6 is also configured to wind the tapes using the gear linkage mechanism 7 when the transport path 620 is being opened. The gear linkage mechanism 7, which is disposed extending from the first frame part 611 to the second frame part 612, forms a drive mechanism that drives the drum 63 or the reels to rotate in the direction in which the tapes are wound, in association with the movement of the first frame part 611 relative to the second frame part 612.

FIG. 8 is a transition diagram showing a rotated state of each gear it the gear linkage mechanism 7 that occurs when the transport path 620 of the banknote storage device 6 is being opened and closed. Dash-dot line circles shown in FIG. 8 indicate the respective gears in the gear linkage mechanism 7. In FIG. 8, P81 indicates the state in which the transport path 620 of the banknote storage device 6 is closed, and P82 indicates the state in which the transport path 620 is open after it was closed. FIG. 8 shows the situation in which the first frame part 611 turns clockwise in FIG. 8 relative to the second frame part 612 (see a dash-dot line arrow) when the transport path 620 is being opened.

When the first frame part 611 turns clockwise in FIG. 8 relative to the second frame part 612, the first idle gear 75 turns (i.e., revolves) clockwise around the center of rotation of the drum 63

Here, the gear linkage mechanism 7 has a preventing member 77. The preventing member 77 prevents the drum gear 72, engaging with the first idle gear 75, and the drum 63, to which the drum gear 72 is attached, from rotating clockwise in FIG. 8 when the first frame part 611 is turning in the direction in which the transport path 620 is opened. The preventing member 77 may be attached to, for example, the shaft 630 of the drum 63.

The preventing member 77 may be configured using, for example, a one-way clutch to prevent the clockwise rotation of the drum gear 72 and the drum 63. The preventing member 77 may have the function of exerting resistance to the drum gear 72 and the drum 63 in the rotation direction when the transport path 620 is being opened. The preventing member 77 may exert resistance to the drum gear 72 and the drum 63 in the rotation direction such that the angle by which the drum gear 72 and the drum 63 rotate clockwise is smaller than the angle by which the first idle gear 75 revolves clockwise. The difference between the angle by which the first idle gear 75 revolves and the angle by which the drum gear 72 rotates is accommodated by the rotation (rotation on its axis) of the first idle gear 75.

By the preventing member 77 preventing the rotation of the drum gear 72 and the drum 63, the first idle gear 75, which revolves around the center of rotation of the drum 63, rotates (rotates on its axis) clockwise as indicated by a solid line arrow in the lower diagram of FIG. 8. In other words, the first idle gear 75 revolves around the center of rotation of the drum 63 while rotating on its axis. During opening of the transport path 620, the gear linkage mechanism 7 serves as a differential gear device. The first idle gear 75 forms a first member that is supported by the first frame part 611 and moves together with the first frame part 611 relative to the second frame part 612.

The first reel gear 73, engaging with the first idle gear 75, rotates counterclockwise in FIG. 8 by the clockwise rotation on its axis of the first idle gear 75 (see a solid line arrow in the lower diagram of FIG. 8). When the first reel gear 73 rotates counterclockwise, the first reel 621 rotates in the direction in which the first tape 641 is wound. The first reel gear 73 is an example of a second member that rotates the first reel 621 in the direction in which the first tape 641 is wound, in response to movement of the first idle gear 75, which is the first member, relative to the second frame part 612. Because the rotation of the drum 63 is prevented, the first tape 641 is substantially prevented from being unwound from the drum 63 or the first reel 621. During opening of the transport path 620, the gear linkage mechanism 7 causes the first reels 621 to rotate in the direction in which the tape is wound, and therefore, the first tape 641 is pulled as indicated by a dashed line arrow in FIG. 8, which substantially prevents the first tape 641 from becoming slack.

The rotation of the drum gear 72 and the drum 63 is prevented, and therefore, the rotation of the second reel gear 74, engaging with the drum gear 72 through the second idle gear 76, is also prevented. The second tape 642 is also substantially prevented from becoming slack when the transport path 620 is being opened.

In order to close the transport path 620, having been open, the first reel gear 73 and the first reel 621 are disconnected from each other. As a result, when the first frame part 611 is turned counterclockwise in FIG. 8 relative to the second frame part 612, the first idle gear 75 revolves counterclockwise around the center of rotation of the drum 63 while rotating on its axis. The first reel gear 73, engaging the first idle gear 75, also rotates. At this time, the first reel gear 73 and the first reel 621 have been disconnected from each other, and therefore, the first reel 621 does not rotate, and the first idle gear 7 and the first reel gear 73 idle. As described above, the first frame part 611 turns together with the first reel 621 and the first tape path 81, and therefore, the shape and length of the first tape path 81 are not or almost not changed. Therefore, when the transport path 620 is being closed the first tape 641 is substantially prevented from becoming slack. In addition, when the transport path 620 is being closed, the rotation of the drum gear 72 is prevented, and therefore, the rotation of the second reel gear 74, engaging with the drum gear 72 through the second idle gear 76, is also prevented. Therefore, the second tape 642 is also substantially prevented from becoming slack when the transport path 620 is being closed.

FIG. 9 shows an example configuration of the gear linkage mechanism 7 that is different from that of FIG. 8. When the transport path 620 is being opened, the gear linkage mechanism 7 shown in FIG. 9 causes the first idle gear 75, which is the first member, to revolve around the center of rotation of the drum 63 and thereby causes the drum gear 72 and the drum 63 to rotate in the tape winding direction.

The gear linkage mechanism 7 of FIG. 9 has a second preventing member 78 that prevents the rotation of the first reel gear 73 and the first reel 621 when the first frame part 611 is turning in the direction in winch the transport path 620 is opened. The second preventing member 78 prevents the rotation of the first reel gear 73 and the first reel 621 when the transport path 620 is transitioning from the closed state indicated by P91 to the open state indicated by P92. The second preventing member 78 may be attached to the first reel unit 651.

The second preventing member 78 may be configured using, for example, a one-way clutch to prevent the rotation of the first reel gear 73 and the first reel 621. The second preventing member 78 may have the function of exerting resistance to the first reel gear 73 and the first reel 621 in the rotation direction when the transport path 620 is being opened. The second preventing member 78 may exert resistance to the first reel gear 73 and the first reel 621 in the rotation direction such that the angle by which the first reel gear 73 and the first reels 621 rotate is smaller than the angle by which the first idle gear 75 rotates on its axis. The difference between the angle by which the first idle gear 75 rotates on its axis and the angle by which the first reel gear 73 rotates is accommodated by the rotation of the drum gear 72.

The second preventing member 78 prevents the rotation of the first reel gear 73 and the first reel 621, so that the rotation on its axis of the first idle gear 75, engaging with the first reel gear 73, is also prevented. The first idle gear 75, being prevented from rotating on its axis, revolves around the center of rotation of the drum 63, so that the drum gear 72 and the drum 63, engaging with the first idle gear 75, rotate clockwise as indicated by a solid line arrow in the lower diagram of FIG. 9. The drum gear 72 is an example of a second member that rotates the drum 63 in the direction in which the first and second tapes 641 and 642 are wound, in response to movement of the first idle gear 75, which is the first member, relative to the second frame part 612. In the configuration of FIG. 9, the gear linkage mechanism 7 also serves as a differential gear device when the transport path 620 is being opened. Note that the second preventing member 78 is attached to the shaft of the first idle gear 75.

In the gear linkage mechanism 7 of FIG. 9, in order to open the transport path 620, the second reel gear 74 and the second reel 622 are disconnected from each other. When the drum gear 72 rotates clockwise, the second idle gear engaging with the drum gear 72, and the second reel gear 74, engaging with the second idle gear 76, each rotate, and the second reel 622 does not rotate. The second idle gear 76 and the second reel gear 74 idle.

By the drum gear 72 and the drum 63 rotating clockwise in the lower diagram of FIG. 9, the first and second tapes 641 and 642 are wound onto the drum 63. As described above, the rotation of the first reel 621 is prevented. The second reel 622 has been disconnected from the second reel gear 74. The first and second tapes 641 and 642 are pulled together as indicated by dashed line arrows in FIG. 9, and therefore, the first and second tapes 641 and 642 are substantially prevented from becoming slack.

In order to close the transport path 620, having been open, as described above, the first reel gear 73 and the first reel 621 may be disconnected from each other. As a result, when the first frame part 611 is turned counterclockwise in FIG. 9 relative to the second frame part 612, the drum gear 72, the second idle gear 76, and the second reel gear 74 do not rotate, and the first idle gear 75 revolves around the center of rotation of the drum 63 while rotating on its axis. By the first idle gear 75 rotating on its axis, the first reel gear 73 also rotates. However, the first reel gear 73 and the first reels 621 have been disconnected from each other, and therefore, the first reel 621 does not rotate. Therefore, the first and second tapes 641 and 642 can be substantially prevented from becoming slack when the transport path 620 is being closed.

Replacement Structure of Reel Units

In tape-type banknote storage devices, for example, when a tape failure such as a break in a tape occurs, the tape and a reel need to be replaced. In the case of conventional banknote storage devices, in order to replace the tape and reel, a user needs to remove the banknote storage device from the banknote processing apparatus, and send the banknote storage device to a repair shop.

In contrast to this, in the banknote storage device 6, the first and second reel units 651 and 652 are each removably attached to the frame 61. Here, the first reel unit 651 has torque limiters 653 that limit the rotational torque of the first reels 621 in addition to the two first reels 621 and the first reel gear 73. Likewise, the second reel unit 652 has torque limiters 654 that limit the rotational torque of the second reels 622 in addition to the two second reels 622 and the second reel gear 74.

The first reel unit 651 is removable from the first flame part 611. Specifically, as shown in FIG. 4, a leading edge portion 6512 (an upper end portion in FIG. 4) of the first reel unit 651 is inserted into a bearing portion 613 of the first frame part 611, and a base end portion 6514 of the shaft 6511 is inserted into an opening portion (not shown) provided in the first frame part 611. The two portions of the first reel unit 651 are rotatably supported by the first frame part 611. Note that the first reel gear 73 is attached to an outer end portion of the first reel unit 651 that is located outward of the base end portion 6514.

An R pin (snap pin) 6513 is attached to the shaft 6511 of the first reel unit 651. The R pin 6513 limits the movement of the first reel unit 651 in the axial direction, i.e. downward in the drawing sheet of FIG. 4, relative to the first frame part 611. The attachment of the R pin 6513 keeps the first reel unit 651 supported by the first frame part 611. By removing the R pin 6513 from the first reel unit 651, the user can move the first reel unit 651 in the axial direction relative to the first frame part 611. By the movement of the first reel unit 651 in the axial direction, the leading edge portion 6512 of the first reel unit 651 is disconnected from the bearing portion 613 of the first frame part 611. In this state, the user can remove the first reel unit 651 from the first frame part 611 by disconnecting the base end portion 6514 of the shaft 6511 from the opening portion of the first frame part 611 (see arrows in FIG. 4). The first reel unit 651 is disconnected from the first frame part 611 in a direction away from the drum 63 (see dash-dot-dot lines in FIG. 4 or dash-dot-dot lines in FIG. 10). Note that the shaft 6511 of the first reel unit 651 may be configured to be attached to the first frame part 611 using an E ring instead of the R pin.

The second reel unit 652 is removable from the second frame part 612. Specifically, as shown in FIG. 4, a leading edge portion 6522 of the second reel unit 652 is inserted into a bearing portion 614 of the second flame part 612, and a base end portion 6524 of the shaft 6521 is inserted into an opening portion (not shown) provided in the second frame part 612. The two portions of the second reel unit 652 are rotatably supported by the second frame part 612. Note that the second reel gear 74 is attached to an outer end portion of the second reel unit 652 that is located outward of the base end portion 6524.

An R pin (snap pin) 6523 is attached to the shaft 6521 of the second reel unit 652. The R pin 6523 limits the movement of the second reel unit 652 in the axial direction, i.e. downward in the drawing sheet of FIG. 4, relative to the second frame part 612. The attachment of the R pin 6523 keeps the second reel unit 652 supported by the second frame part 612. By removing the R pin 6523 from the second reel unit 652, the user can move the second reel unit 652 in the axial direction relative to the second frame part 612. By the movement of the second reel unit 652 in the axial direction the leading edge portion 6522 of the second reel unit 652 is disconnected from the hearing portion 614 of the second frame part 612. In this state, the user can remove the second reel unit 652 from the second frame part 612 by disconnecting the base end portion 6524 of the shaft 6521 from the opening portion of the second frame part 612 (see arrows in FIG. 4). The second reel unit 652 is disconnected from the second frame part 612 in a direction away from the drum 63 (see dash-dot-dot lines in FIG. 4 or dash-dot-dot lines in FIG. 3). Note that the shaft 6521 of the second reel unit 652 may be configured to be attached to the second frame part 612 using an E ring instead of the R pin.

With this configuration, a maintenance person who maintains the banknote processing apparatus 1 can easily manually remove the first and second reel units 651 and 652 of the banknote storage device 6 from the banknote storage device 6. When a tape failure occurs, the tapes and reels of the banknote storage device can be replaced at a site where the banknote processing apparatus 1 is installed. The maintenance cost of the banknote storage device 6 is reduced.

Figure 10:
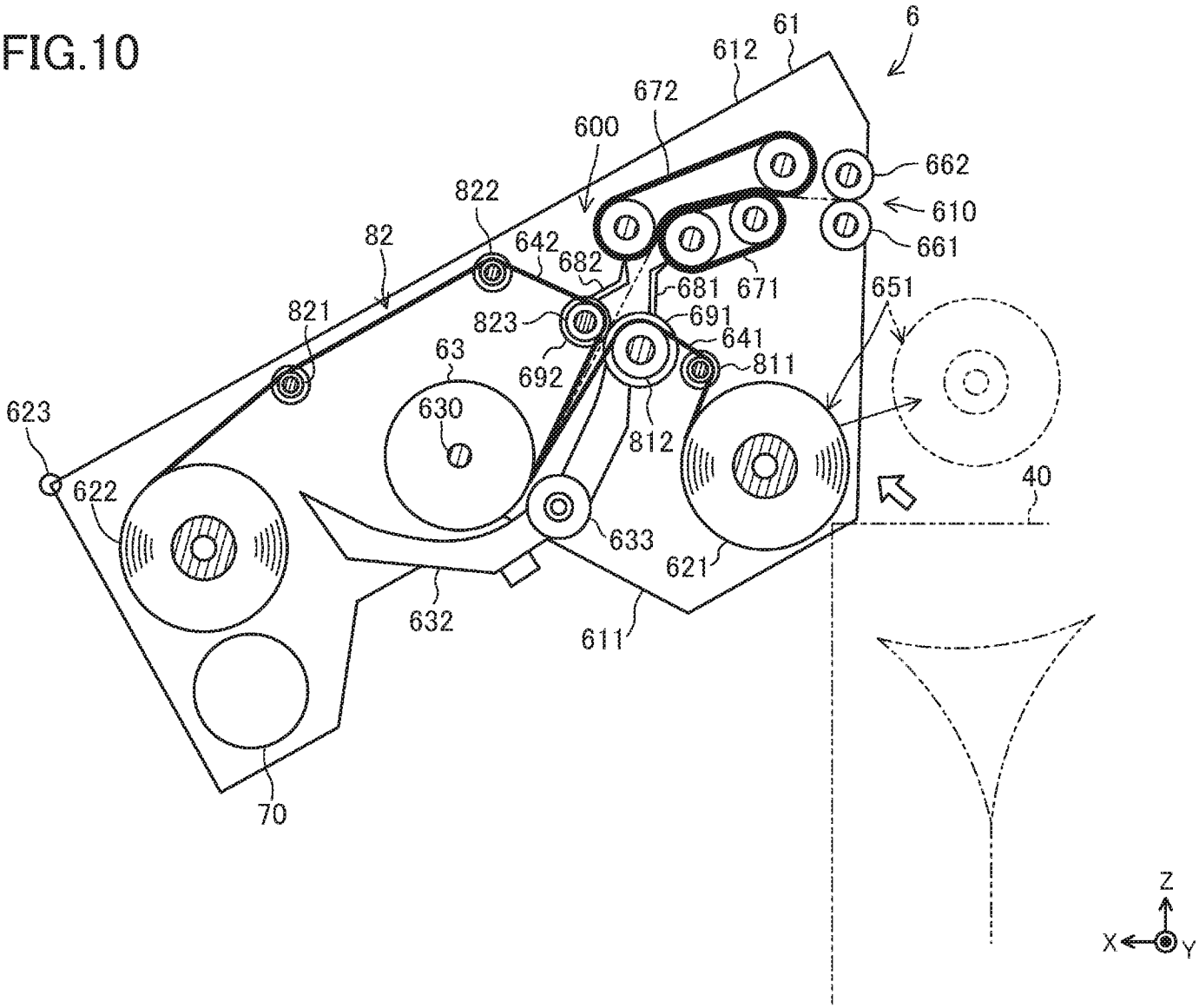
FIG. 10 is a diagram for describing removal of a reel unit of a banknote storage device, corresponding to FIG. 3.

Specifically, as shown in FIG. 3, the maintenance person can remove the second reel unit 652 forward, i.e. leftward in the drawing sheet of FIG. 3, from the banknote storage device 6, with the banknote storage device 6 having been pulled out of the banknote processing apparatus 1. In addition, as shown in FIG. 10, the maintenance person can remove the first reel unit 651 backward, i.e. rightward in the drawing sheet of FIG. 10, from the banknote storage device 6, while avoiding obstruction of the transport member 40, by turning the banknote storage device 6 upward around the second pivot shaft 623.

Conversely, the maintenance person can attach the second reel unit 652 to the banknote storage device 6 from the front of the banknote storage device 6. The maintenance person can also attach the first reel unit 651 to the banknote storage device 6 from the back of the banknote storage device 6. The maintenance person can replace the first and second reel units 651 and 652 without removing the banknote storage device 6 from the banknote processing apparatus 1.

In order to remove the first and second reel units 651 and 652 from the banknote storage device 6, the leading edge of the first tape 641 and the leading edge of the second tape 642 need to be removed from the outer peripheral surface of the drum 63. In order to attach the first reel unit 651 to the banknote storage device 6, the first tape 641 needs to be wrapped around the first and second tape pulleys 811 and 812, and the leading edge of the first tape 641 needs to be attached to the outer peripheral surface of the drum 63. Likewise, in order to attach the second reel unit 652 to the banknote storage device 6, the second tape 642 needs to be wrapped around the third tape pulley 821, the fourth tape pulley 822, and the fifth tape pulley 823, and the leading edge of the second tape 642 needs to be attached to the outer peripheral surface of the drum 63.

As described above, the frame 61 of the banknote storage device 6 has the shaft 630 as the first pivot shaft, and the second pivot shaft 623. As shown in FIG. 7, by turning the first and second frame parts 611 and 612 on the shaft 630 and the second pivot shaft 623, respectively, the inside of the banknote storage device 6 can be largely opened. Therefore, the maintenance person can insert their hand into the banknote storage device 6 from various directions such as directions indicated by open arrows shown in FIGS. 7 and 10, and perform an operation of handling the tapes with the banknote storage device 6 remaining attached to the banknote processing apparatus 1. Specifically, the maintenance person can easily remove the leading edges of the first and second tapes 641 and 642 fixed to the outer peripheral surface of the drum 63, from the drum 63, and fix the leading edges of the first and second tapes 641 and 642 to the outer peripheral surface of the drum 63. The maintenance person can also easily wrap the first tape 641 around the first and second tape pulleys 811 and 812, and wrap the second tape 642 around the third tape pulley 821, the fourth tape pulley 822, and the fifth tape pulley 823. The banknote storage device 6 has high maintainability.

Note that a member having a greater stiffness than that of the first tape 641 may be attached to an end of the first tape 641. Likewise, a member having a greater stiffness than that of the second tape 642 may be attached to an end of the second tape 642. With that configuration, the maintenance person can easily remove the end of the first tape 641 from the drum 63 or the first reel 621, and fix the end of the first tape 641 to the drum 63 or the first reel 621. Likewise, the maintenance person can easily remove the end of the second tape 642 from the drum 63 or the second reel 622, and fix the end of the second tape 642 to the drum 63 or the second reel 622.

With the above configuration, the first reel unit 651 having the two first reels 621 and the second reel unit 652 having the two second reels 622 are attached to and detached from the frame 61. The first and second reels 621 and 622 are not configured to be individually attached to or detached from the frame 61 of the banknote storage device 6. The maintenance person can easily replace the tapes and reels.

Second Example Configuration of Banknote Storage Device

FIGS. 11-14 show a second example configuration of a banknote storage device 9. An input and output opening 910 through which a banknote 100 is input and output is provided in a side surface (a right surface in the example of FIG. 11) of the banknote storage device 9. The banknote storage device 9 includes a storage mechanism 900, and a frame 91 that accommodates the storage mechanism 900. Like the above storage mechanism 600, the storage mechanism 900 is configured so that the banknote 100, which is sandwiched between tapes, is wound together with the tapes onto a drum 93. The storage mechanism 900 includes two first reels 921, two second reels 922 and the drum 93. The frame 91 has a first frame part 911 and a second frame part 912. Note that in FIG. 11, only one reel is shown. This is because, as described below, a total of four reels are located at different positions in the Y direction, and at the same position in the X direction and the Z direction.

Figure 13:
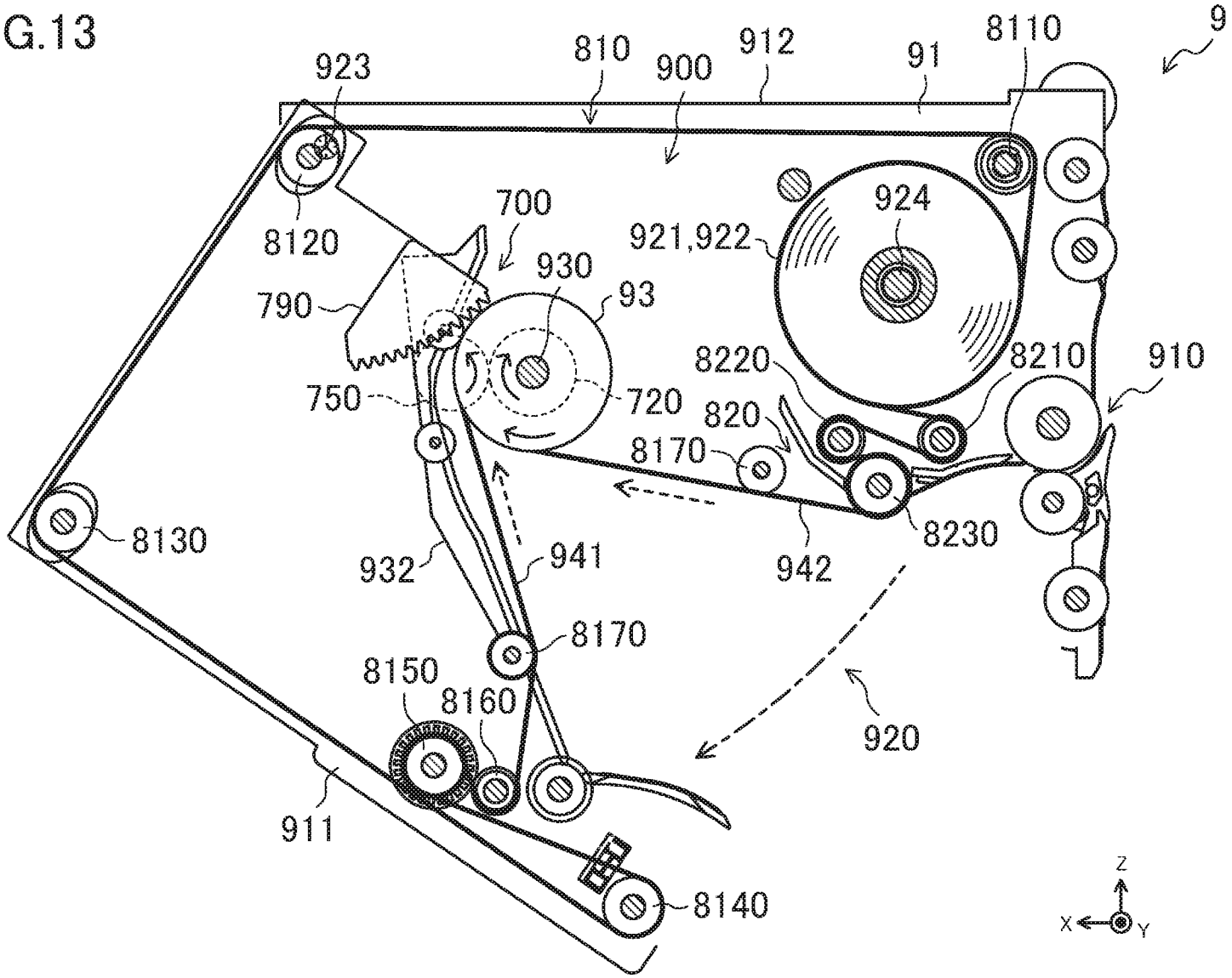
FIG. 13 is a diagram showing a state in which the tape path of the banknote storage device of the second example configuration is open, corresponding to FIG. 11.

The first frame part 911 is pivotably supported by the second frame part 912 at the position of a pivot shaft 923. The pivot shaft 923 is located at an opposite side portion front the input and output opening 910. As shown in FIG. 13, when the first frame part 911 turns around the pivot shaft 923, at least a portion of a transport path 920 extending from the input and output opening 910 to the drum 93 is opened, in the example configuration of FIG. 13, the banknote storage device 9 is configured so that the entire transport path 920 can be opened.

First tapes 941 unwound from the first reels 921 and second tapes 942 unwound from the second reels 922, stacking together, are wound onto the outer peripheral surface of the drum 93. The banknote 100 is sandwiched between the first tapes 941 and the second tapes 942.

Figure 12:
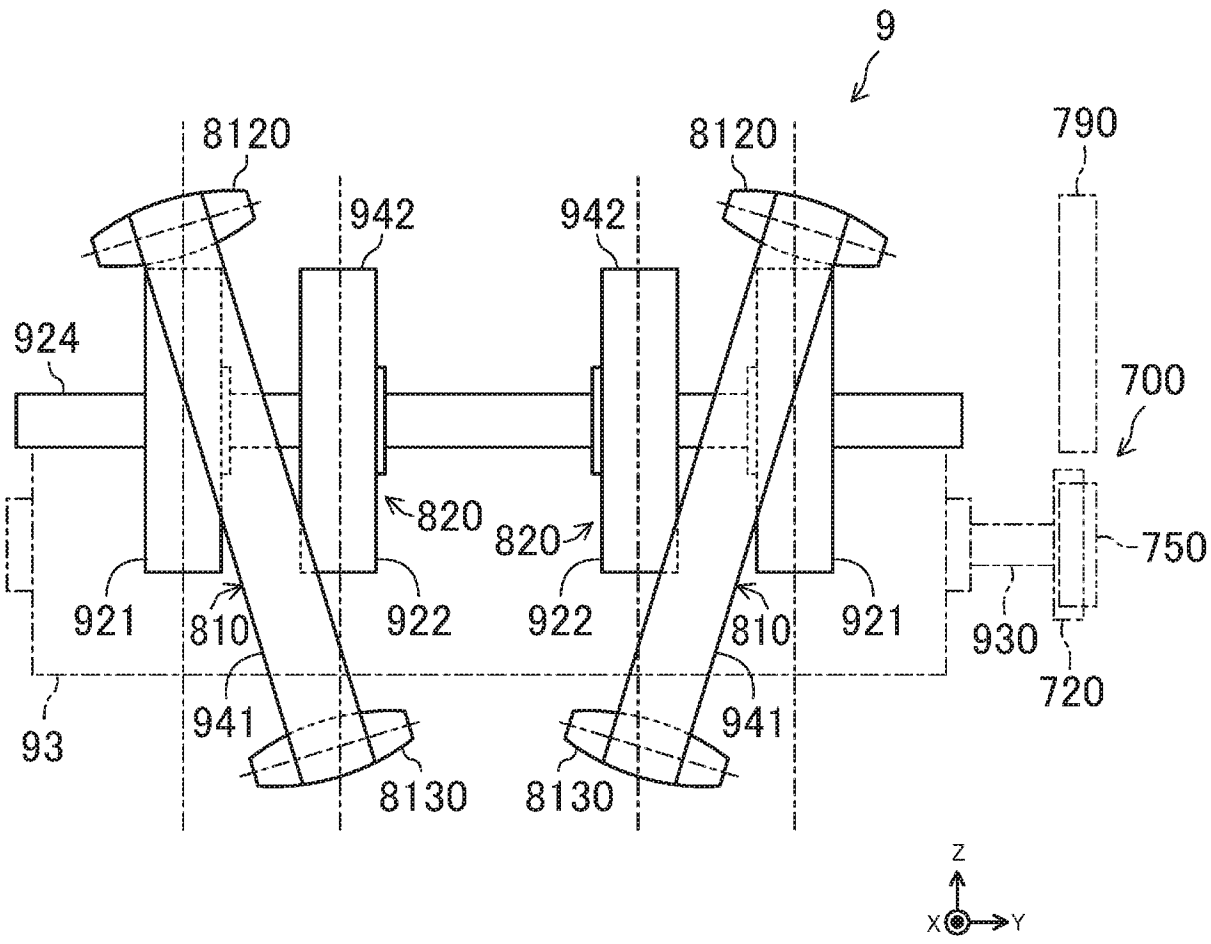
FIG. 12 is a side view showing a configuration of a tape path of the banknote storage device of the second example configuration.

As shown in FIG. 12, in the banknote storms device 9, the two first reels 921 and the two second reels 922 are coaxially disposed. In other words, the first reels 921 and the second reels 922 are located at different positions in the Y direction, and at the same position in the X direction and the Z direction. A shaft 924 that supports the first reels 921 and the second reels 922 is supported by the second frame part 912. The shaft 924 supports the two first reels 921 and the two second reels 922 in a manner that allows the four reels to rotate separately. By disposing the four reels coaxially, the space of the banknote storage device 9 in which the reels are disposed can be saved. The size of the banknote storage device 9 can be reduced without a decrease in the storage amount of banknotes.

The two first reels 921 are spaced apart from each other in the Y direction. The two second reels 922 are also spaced apart in the Y direction. In a set of one of the first reels 921 and one of the second reels 922 that are disposed on the left side of the drawing sheet of FIG. 12, that second reel 922 is disposed closer to the center in the Y direction of the banknote storage device 9, and that first reel 921 is disposed on an outer side in the Y direction of the banknote storage device 9. Likewise, in a set of one of the first reels 921 and one of the second reels 922 that are disposed on the right side of the drawing sheet of FIG. 12, that second reel 922 is disposed closer to the center in the Y direction of the banknote storage device 9, and that first reel 921 is disposed on an outer side in the Y direction of the banknote storage device 9.

The first tape 941 unwound from the first reel 921 moves along a first tape path 810 to reach the drum 93. The second tape 942 unwound from the second reel 922 moves along a second tape path 820 to reach the drum 93. The first tape path 810 is formed by a first tape pulley 8110, a second tape pulley 8120, a third tape pulley 8130, a fourth tape pulley 8140, a fifth tape pulley 8150, a sixth tape pulley 8160 and a seventh tape pulley pair 8170. Note that although not shown, there are two first tape pulleys 8110, two second tape pulleys 8120, two third tape pulleys 8130, two fourth tape pulleys 8140, two fifth tape pulleys 8150, two sixth tape pulleys 8160, and two seventh tape pulley pairs 8170, corresponding to the two first tapes 941. The second tape path 820 is formed by an eighth tape pulley 8210, a ninth tape pulley 8220, a tenth tape pulley 8230, and the seventh tape pulley pair 8170. There are two eighth tape pulleys 8210, two ninth tape pulleys 8220, and two tenth tape pulleys 8230, corresponding to the two second tapes 942.

The second tape 942 unwound from the second reel 922 is wrapped around the eighth tape, pulley 8210, the ninth tape pulley 8220, the tenth tape pulley 8230, and the seventh tape pulley pair 8170 in this order, and reaches the drum 93. The eighth tape pulley 8210, the ninth tape pulley 8220, the tenth tape pulley 8230, and one of the seventh tape pulley pair 8170 are attached to the second frame part 912. The second frame part 912 forms a portion of the second tape path 820.

The first tape 941 unwound from the first reel 921 is wrapped around the first tape pulley 8110, the second tape pulley 8120, the third tape 8130, the fourth tape pulley 8140, the fifth tape pulley 8150, the sixth tape pulley 8160, and the seventh tape pulley pair 8170 in this order, and reaches the drum 93. The first tape path 810 is formed to go around the drum 93. The first tape pulley 8110 is attached to the second frame part 912. The second tape pulley 8120, the third tape pulley 8130, the fourth tape pulley 8140, the fifth tape pulley 8150, the sixth tape pulley 8160, and one of the seventh tape pulley pair 8170 are attached to the first frame part 911. The first frame part 911 forms a portion of the first tape path 810.

More specifically, one of the seventh tape pulley pair 8170 is attached to a movable guide 932. The movable guide 932 is supported by the first frame part 911. A base end portion, i.e. a right end portion in FIG. 11, of the movable guide 932 is attached to the first frame part 911 in a manner that allows the movable guide 932 to turn relative to the first frame part 911. The movable guide 932 is pressed clockwise in FIG. 11 by a pressing member (e.g., spring) (not shown). The movable guide 932 turns clockwise and counterclockwise, depending on the magnitude of the diameter of the drum 93.

Each second tape pulley 8120 changes the movement direction of the first tape 941 between the X direction and the Z direction. As shown in FIG. 12, the axis of rotation of each second tape pulley 8120 is tilted. More specifically, each second tape pulleys 8120 are located at the same or almost the same position in the direction as that of the first reel 921. The axis of rotation of each second tape pulley 8120 is tilted so that the outer side in the Y direction of the axis of rotation is lower than the inner side (closer to the center) in the Y direction of the axis of rotation. The axis of rotation of the second tape pulley 8120 disposed on the left side of the drawing sheet of FIG. 12 is tilted up to the right. The axis of rotation of the second tape pulley 8120 disposed on the right side of the drawing sheet of FIG. 12 is tilted down to the right.

Each third tape pulley 8130 also changes the movement direction of the first tape 941 between the X direction and the Z direction. As shown in FIG. 12, the axis of rotation of each third tape pulley 8130 is also tilted. Each third tape pulley 8130 is located at the same or almost same position in the direction as that of the second reel 922. The axis of rotation of each third tape pulley 8130 is parallel to the axis of rotation of the corresponding second tape pulley 8120. Specifically, the axis of rotation of each third tape pulley 8130 is tilted so that the outer side in the direction of the axis of rotation is lower than the inner side (closer to the center) in the Y direction of the axis of rotation. The axis of rotation of the third tape pulley 8130 disposed on the left side of the drawing sheet of FIG. 12 is tilted up to the right. The axis of rotation of the third tape pulley 8130 disposed on the right side of the drawing sheet of FIG. 12 is tilted down to the right.

The first tape 941 unwound from the first reel 921 is wrapped around the second tape pulley 8120 and the third tape pulley 8130, so that the position in the Y direction of the first tape 941 is changed from the position of the first reel 921 to the position of the second reel 922. Thereafter, as described above, the first tape 941 is wrapped around the fourth tape pulley 8140, the fifth tape pulley 8150, and the sixth tape pulley 8160, and reaches the seventh tape pulley pair 8170. At this time, the first tape 941 is located at the same position in the Y direction as that of the second tape 942. The seventh tape pulley pair 8170 causes the first and second tapes 941 and 942 to stack together, and guides the first and second tapes 941 and 942 toward the outer peripheral surface of the drum 93. The banknote 100 is sandwiched between the first tape 941 and the second tape 942 at the position of the seventh tape pulley pair 8170.

Conversely, the first tape 941 unwound from the drum 93 is wrapped around the third tape pulley 8130 and the second tape pulley 8120, so that the position in the Y direction of the first tape 941 is changed from the position of the second reel 922 to the position of the first reel 921. Thereafter, the first tape 941 reaches the first reel 921 through the first tape pulley 8110.

Figure 11:
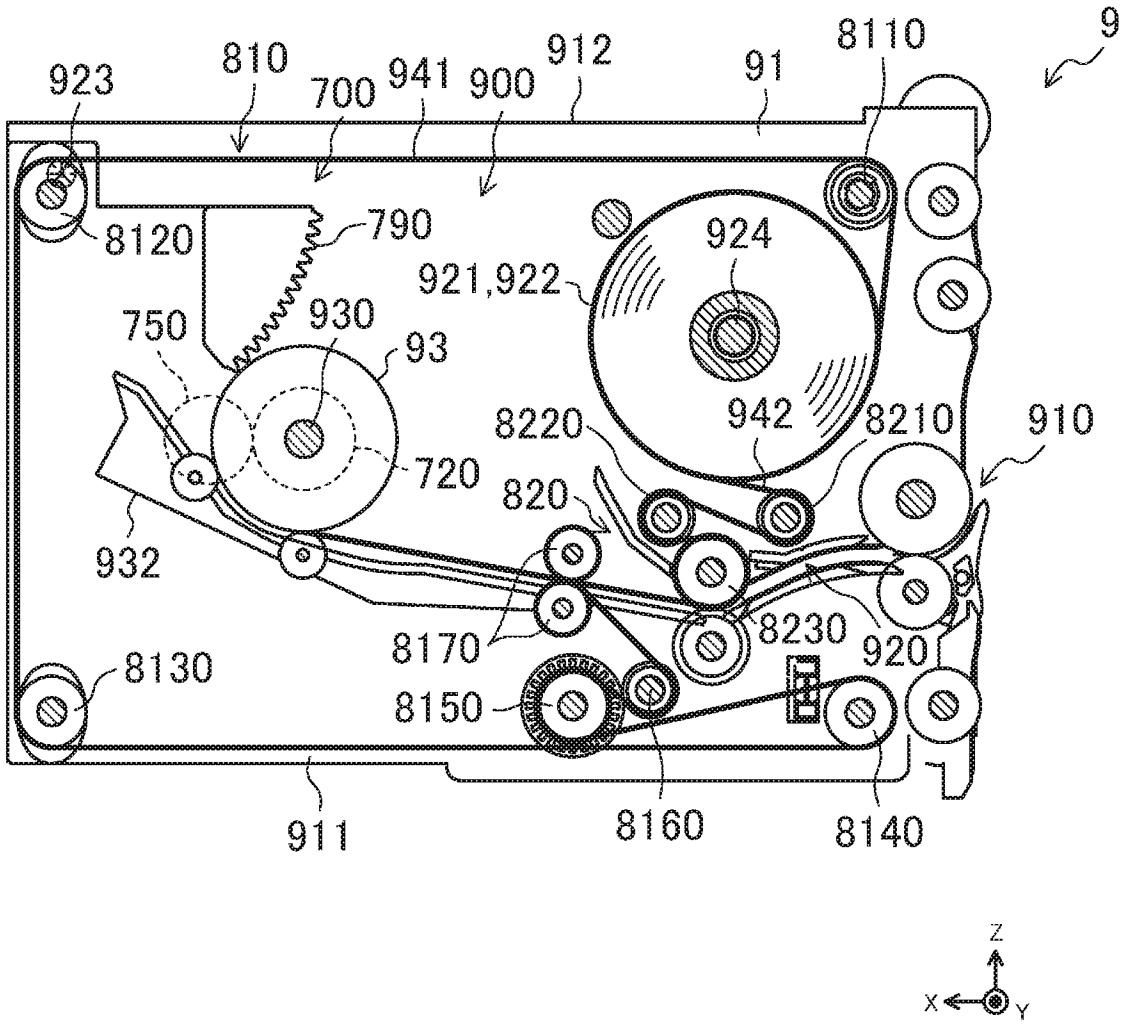
FIG. 11 is a cross-sectional view showing an internal configuration of a banknote storage device according to a second example configuration.

The banknote storage device 9 is also configured so that the tapes are wound when the transport path 920 is being opened. The banknote storage device 9 includes a drive mechanism 700. As shown in FIGS. 11-13, the drive mechanism 700 has a drum gear 720, an idle gear 750, and a frame gear 790. The drum gear 720 is attached to the drum 93. The frame gear 790 is attached to the first frame part 911. The idle gear 750 engages with the drum gear 720. The drive mechanism 700 is disposed extending from the first frame part 911 to the second frame part 912. As described below, the frame gear 790 is an example of a first member that is supported by the first frame part 911, and moves together with the first frame part 911 relative to the second frame part 912. The drum gear 720 and the idle gear 750 are an example of a second member that rotates the drum 63 in the tape winding direction in association with the movement of the frame gear 790, which is the first member, relative to the second frame part 912.

The center of rotation of the drum gear 720 is coincident with the center of rotation of the drum 93. A one-way clutch (not shown) is interposed between the drum gear 720 and the drum 93. When the drum gear 720 rotates clockwise in FIG. 13, the one-way clutch transmits a rotary force to the drum 93, which is then rotated clockwise. When the drum gear 720 rotates counterclockwise in FIG. 13, the one-way clutch does not transmit a rotary force to the drum 93, which is therefore not rotated. The drum gear 720 idles.

The drum gear 720 and the idle gear 750 engage with each other. When the idle gear 750 rotates, the drum gear 720 rotates. In the state in which the first frame part 911 and the second frame part 912 forms the transport path 920, i.e. the state in which the banknote storage device 9 is in use as shown in FIG. 11, the frame gear 790 does not engage with the idle gear 750. As shown in FIG. 13, when the first frame part 911 rums around the pivot shaft 923, the turning of the first frame part 911 around the pivot shaft 923 causes the frame gear 790 to engage with the idle gear 750.

The frame gear 790 is a portion of a gear having the pivot shaft 923 as the center thereof. As indicated by a dash-dot line arrow in FIG. 13, when the first frame part 911 rotates clockwise relative to the second frame part 912, the frame gear 790 turns around the pivot shaft 923 to engage with the idle gear 750. When the frame gear 790 engages with the idle gear 750, the idle gear 750 rotates counterclockwise as indicated by an arrow in FIG. 13. As a result, the drum gear 720, engaging with the idle gear 750, rotates clockwise in FIG. 13. The drum 93 rotates in the direction in which the first and second tapes 941 and 942 are wound.

Here, a preventing member (not shown) prevents the rotation of the first and second reels 921 and 922. As a result, as indicated by dashed line arrows in FIG. 13, the first and second tapes 941 and 942 are pulled, and therefore, are substantially prevented from becoming slack.

When the first frame part 911 is turned counterclockwise in FIG. 13 relative to the second frame part 912 in order to close the transport path 920, having been open, the frame gear 790 turns counterclockwise around the pivot shaft 923. The idle gear 750, engaging with the frame gear 790, rotates clockwise, and the drum gear 720 rotates counterclockwise. In this case, the above one-way clutch causes the drum gear 720 to idle, and therefore, the drum 63 does not rotate. The first frame part 911 turns together with a portion of the first tape path 810, and therefore, the length of the first tape path 810 is not or almost not changed. Therefore, when the transport path 920 is being closed, the first tape 941 is substantially prevented from becoming slack. In addition, when the transport path 920 is being closed, the rotation of the drum 93 is prevented, and therefore, the second tape 942 is also substantially prevented from becoming slack.

In the state in which the banknote storage device 9 is in use, the frame gear 790 does not engage with the idle gear 750, and therefore, has not an influence on the drum 93. The drive mechanism 700 can avoid an increase in the load of a motor for rotating the drum 93 when the banknote storage device 9 is in use.

Motion of Movable Guide when Transport Path is Being Opened

As described above, the movable guide 932 is pressed clockwise in FIG. 11 by the pressing member. The movable guide 932 presses the banknote 100, the first tapes 941, and the second tapes 942 which are wound around the drum 93.

As shown in FIG. 13, even when the transport path 920 is open after the first frame part 911 has turned, the movable guide 932 may be pressed clockwise by the pressing member. As a result, even when the transport path 920 is open, the movable guide 932 can press the banknote 100, the first tape 941, and the second tape 942. The banknote storage device 9 can maintain the stored state of the banknote 100.

The movable guide 932 may be configured to allow the user to manually remove the pressing of the pressing member. If the user removes the pressing of the movable guide 932 before the transport path 920 is opened, the movable guide 932 is separated from the outer peripheral surface of the drum 93 when the transport path 920 is opened, as shown in, for example, FIG. 14. For example, a failure that a portion of a banknote gets jammed between the movable guide 932 and the drum 93 when the user tires to remove the banknote, can be substantially prevented from occurring.

Note that the removal of the pressing of the movable guide 932 is not limited to manual removal. For example, the banknote storage device 9 may be configured so that the pressing is removed in association with the turning of the first frame part 911 to open the transport path 920, and the pressing, having been removed, is resumed in association with the turning of the first frame part 911 to close the transport path 920.

Figure 14:
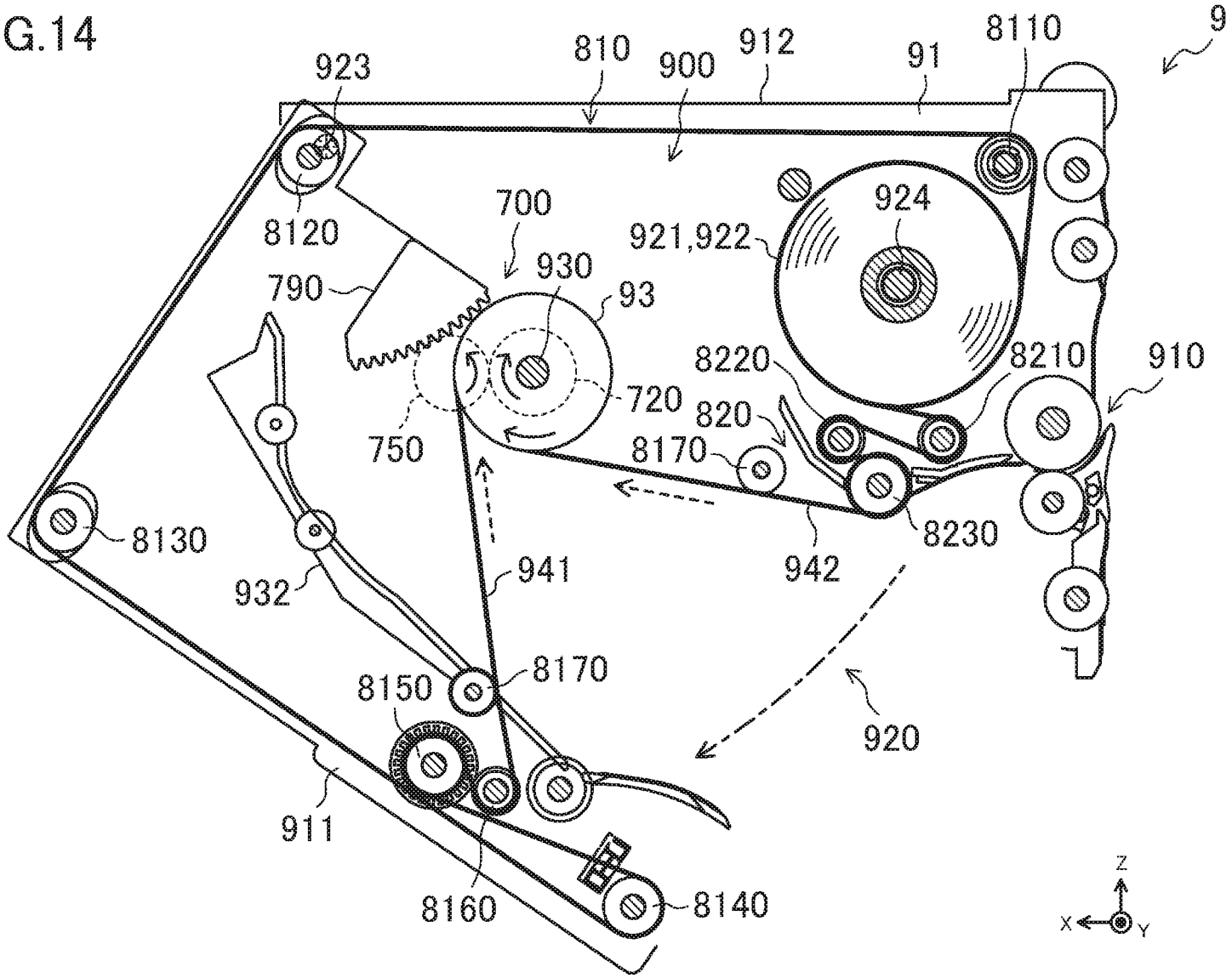
FIG. 14 is a diagram showing a state in which the tape path of the banknote storage device of the second example configuration is open, and a pressing force to a movable guide has been removed, corresponding to FIG. 11.

The timing with which the pressing of the movable guide 932 is removed is not particularly limited. For example, as shown in FIG. 13, when the transport path 920 is open after the first frame part 911 has turned, the movable guide 932 may be pressed clockwise by the pressing member. Thereafter, as shown in FIG. 14, when the user manually removes the pressing of the pressing member as required, the movable guide 932 can be separated from the outer peripheral surface of the drum 93. Note that the user performs an operation of resuming the pressing, having been removed, before or after closing the transport path 920. Alternatively, as described above, the banknote storage device 9 may be configured so that the pressing, having been removed, is resumed in association with the turning of the first frame part 911 to close the transport path 920.

Figure 15:
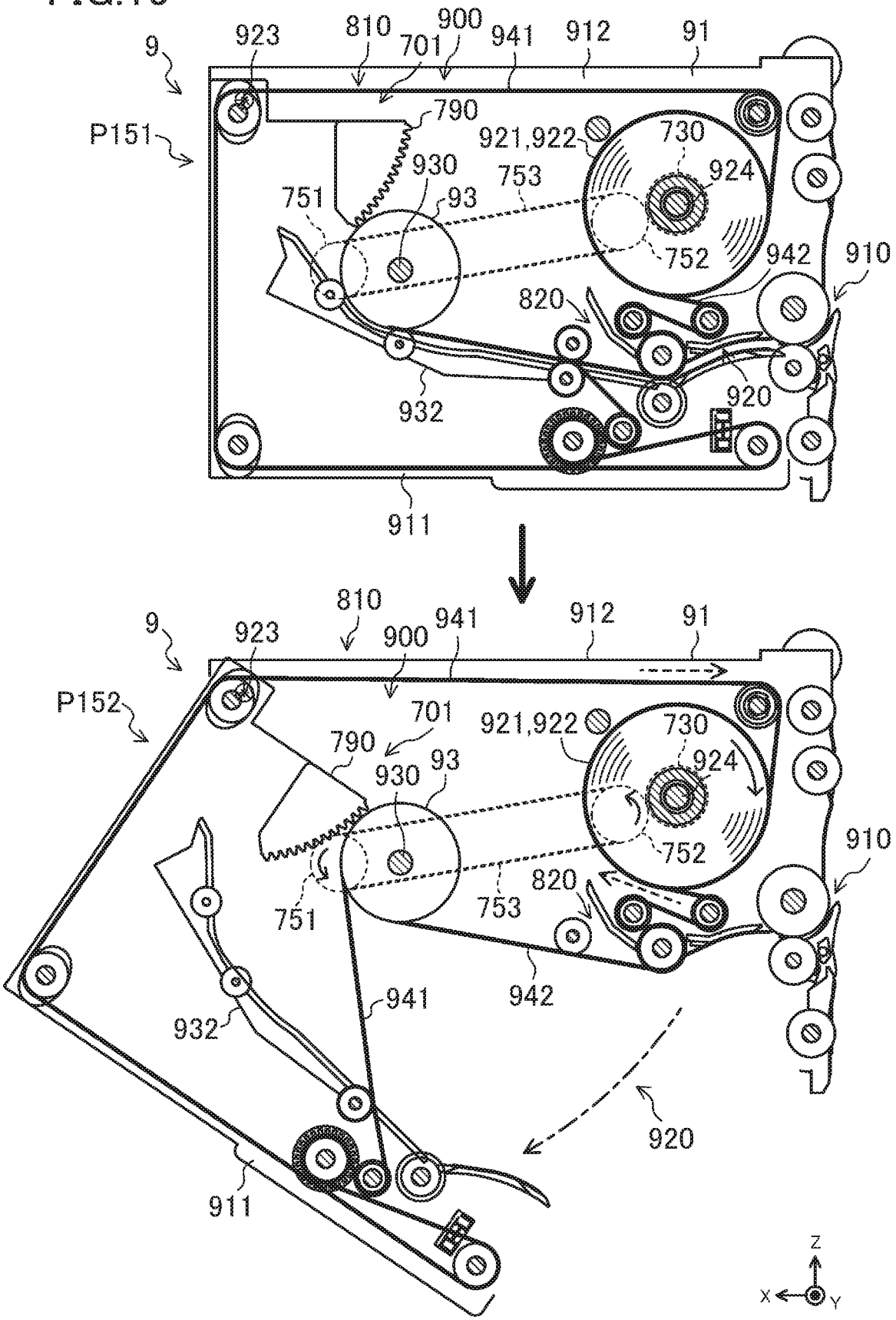
FIG. 15 is a transition diagram showing rotated states of a drum and a reel that occur when a transport path of a banknote storage device according to variation is opened.

FIG. 15 shows an example configuration of a drive mechanism 701 that is different from that of FIG. 11. The drive mechanism 701 of FIG. 15 substantially prevents the first and second tapes 941 and 942 from becoming slack by rotating the first and second reels 921 and 922 when the transport path 920 is being opened.

The drive mechanism 701 has the above frame gear 790, a first gear 751 that engages with the frame gear 790, a reel gear 730 attached to the reel shaft 924, and a second gear 752 that engages with the reel gear 730. In the example configuration of FIG. 15, the first gear 751 and the second gear 752 are linked together by a belt 753. The belt 753 transmits a rotary force between the first gear 751 and the second gear 752. The drive mechanism 701 is disposed extending from the first frame part 911 to the second frame part 912. As described below, the frame gear 790 is an example of a first member that is supported by the first frame part 911, and moves together with the first frame part 911 relative to the second frame part 912. The first gear 751, the second gear 752, the belt 753, and the reel gear 730 are an example of a second member that rotates the first and second reels 921 and 922 in the tape winding direction in association with the movement of the frame gear 790, which is the first member, relative to the second frame part 912.

In a state P151 in which the banknote storage device 9 is in use as shown in the upper diagram of FIG. 15, the frame gear 790 does not engage with the first gear 751. As shown in the lower diagram of FIG. 15, when the first frame part 911 turns around the pivot shaft 923 (P152), the turning of the first frame part 911 around the pivot shaft 923 causes the frame gear 790 to engage with the first gear 751. When the frame gear 790 and the first gear 751 engage with each other, the first gear 751 rotates counterclockwise as indicated by an arrow shown in the lower diagram of FIG. 15. As a result, the second gear 752 also rotates counterclockwise through the belt 753. The reel gear 730, engaging with the second gear 752, rotates clockwise in FIG. 15. The first and second reels 921 and 922 rotate in the direction in which the first and second tapes 941 and 942 are wound.

A preventing member (not shown) prevents the rotation of the drum 93. As a result, as indicated by dashed lines shown in the lower diagram of FIG. 15, the first and second tapes 941 and 942 are pulled, and therefore, are substantially prevented from becoming slack.

When the first frame part 911 is turned counterclockwise in FIG. 15 relative to the second frame part 912 in order to close the transport path 920, having been open, the frame gear 790 turns counterclockwise around the pivot shaft 923. The first gear 751, engaging with the frame gear 790, rotates clockwise, and the second gear 752 also rotates clockwise. The reel gear 730, engaging with the second gear 752, rotates counterclockwise. If a one-way clutch is interposed between the reel gear 730 and the shaft 924, then when the one-way clutch causes the reel gear 730 to idle, the first and second reels 921 and 922 do not rotate. The first and second tapes 941 and 942 can be substantially prevented from becoming slack when the transport path 920 is being closed.

Note that the tape-type storage units 51 of the banknote processing apparatus 1 may have the same configuration as that of the banknote storage device 6 of FIGS. 3-6 or the banknote storage device 9 of FIGS. 11 and 12. The tape-type storage units 51 included in the storage unit 5 are an example sheet storage device.

Although the above banknote storage devices have two first tapes and two second tapes, the number of tapes in a banknote storage device to which the technology disclosed herein is applicable is not particularly limited. The number of tapes may be appropriately determined. In addition, although the banknote storage devices store banknotes sandwiched between the first and second tapes, the configuration of the tape-type banknote storage device for storing banknotes is not particularly limited. The tape-type banknote storage device may have various configurations.

The drum may be supported by the first frame part.

Although the above banknote storage devices have the first and second frame parts that move relative to each other, the banknote storage devices may further have, for example, a third frame part. For example, the banknote storage devices may be configured so that the drum is supported by the third frame part.

In addition, the technology disclosed herein is not limited to use in a banknote processing apparatus and a banknote storage device. The technology disclosed herein is widely applicable to, for example, sheet processing apparatuses and sheet storage devices that process sheets including checks, coupons, and various securities.

What is claimed is:

1. A sheet storage device comprising:
a reel around which a tape is wound;
a drum onto which a sheet is wound together with the tape;
an input and output opening through which the sheet is passed; and
a frame configured to form at least a portion of a transport path on which the sheet is transported from the input and output opening to the drum,
wherein
the frame has a first frame part and a second frame part,
the first frame part and the second frame part are configured to move relative to each other to switch between a state in which the transport path is formed and a state in which at least a portion of the transport path is open,
the first frame part supports the reel, and forms a tape path extending from the reel to the drum, and
the first frame part turns together with the reel and the tape path around a center of rotation of the drum relative to the second frame part.

2. The sheet storage device of claim 1, further comprising:
a second reel around which a second tape is wound,
wherein
the second frame part forms a second tape path extending from the second reel to the drum, and
the second frame part moves together with the second tape path relative to the first frame part.

3. The sheet storage device of claim 2, wherein
the drum is disposed between the reel and the second reel at least in a closed state of the transport path.

4. The sheet storage device of claim 3, further comprising:
a movable guide configured to be brought into contact with the tape wound around the drum, and move depending on a change in the magnitude of a diameter of the drum,
wherein
a winding position where the tape and the second tape are wound onto the drum is located between the drum and the reel, and
the movable guide is disposed between the winding position and the reel.

5. A sheet processing apparatus comprising:
the sheet storage device of claim 1.

6. The sheet processing apparatus of claim 5, further comprising:
a housing configured to house the sheet storage device; and
a sheet transporter disposed in the housing and coupled to the input and output opening of the sheet storage device, and configured to transport the sheet toward the input and output opening or from the input and output opening,
wherein
the first frame part and the second frame part form the input and output opening, and
a part forming the input and output opening of the first frame part or the second frame part is linked to the sheet transporter with the first frame part and the second frame part having moved relative to each other to open the transport path.

7. The sheet processing apparatus of claim 6, wherein
the sheet storage device has
a first pivot shaft configured to allow the first frame part and the second frame part to move relative to each other, and
a second pivot shaft configured to allow the sheet storage device to move relative to the sheet transporter.

8. A sheet storage device comprising:
a reel around which a tape is wound;
a drum onto which a sheet is wound together with the tape;
an input and output opening through which the sheet is passed;
a frame configured to form at least a portion of a transport path on which the sheet is transported from the input and output opening to the drum; and
a second reel around which a second tape is wound,
wherein
the frame has a first frame part and a second frame part,
the first frame part and the second frame part are configured to move relative to each other to switch between a state in which the transport path is formed and a state in which at least a portion of the transport path is open,
the first frame part supports the reel, and forms a tape path extending from the reel to the drum,
the first frame part moves together with the reel and the tape path relative to the second frame part,
the second frame part forms a second tape path extending from the second reel to the drum,
the second frame part supports the second reel, and
the second frame part moves together with the second reel and the second tape path relative to the first frame part.

9. A sheet storage device comprising:
a reel around which a tape is wound;
a drum onto which a sheet is wound together with the tape;
an input and output opening through which the sheet is passed;
a frame configured to form at least a portion of a transport path on which the sheet is transported from the input and output opening to the drum; and
a second reel around which a second tape is wound, wherein
the frame has a first frame part and a second frame part,
the first frame part and the second frame part are configured to move relative to each other to switch between a state in which the transport path is formed and a state in which at least a portion of the transport path is open,
the first frame part supports the reel, and forms a tape path extending from the reel to the drum,
the first frame part moves together with the reel and the tape path relative to the second frame part,
the second frame part forms a second tape path extending from the second reel to the drum,
the second frame part moves together with the second tape path relative to the first frame part, and
the second frame part supports the drum.

10. A sheet storage device comprising:
a reel around which a tape is wound;
a drum onto which a sheet is wound together with the tape;
an input and output opening through which the sheet is passed; and
a frame configured to form at least a portion of a transport path on which the sheet is transported from the input and output opening to the drum,
wherein
the frame has a first frame part and a second frame part,
the first frame part and the second frame part are configured to move relative to each other to switch between a state in which the transport path is formed and a state in which at least a portion of the transport path is open,
the first frame part forms at least a portion of a tape path extending from the reel to the drum, and moves together with the tape path relative to the second frame part,
the sheet storage device further comprises a gear linkage drive disposed extending from the first frame part to the second frame part, and
the gear linkage drive rotates the drum or the reel in a direction in which the tape is wound, in association with the movement of the first frame part relative to the second frame part.

11. The sheet storage device of claim 10, wherein
the gear linkage drive has at least
a first member supported by the first frame part, and configured to move together with the first frame part relative to the second frame part, and
a second member configured to rotate the drum or the reel in a direction in which the tape is wound, in response to the movement of the first member relative to the second frame part.

12. The sheet storage device of claim 11, wherein
the reel is supported by the first frame part or the second frame part,
the drum is supported by the second frame part or the first frame part, and
the reel and the drum are coupled together through the gear linkage drive.

13. The sheet storage device of claim 12, wherein
the first frame part supports the reel, and turns together with the reel and the tape path around a center of rotation of the drum relative to the second frame part,
the second frame part supports the drum,
the gear linkage drive has a drum gear linked to the drum, a reel gear linked to the reel, and an idle gear engaging with both the drum gear and the reel gear,
the idle gear is the first member, and during the turning of the first frame part relative to the second frame part, the idle gear revolves around the center of rotation of the drum with the idle gear engaging with both the drum gear and the reel gear.

14. The sheet storage device of claim 13, wherein
the gear linkage drive has a rotation preventer configured to prevent rotation of the drum gear and the drum during the turning of the first frame part relative to the second frame part in a direction in which the transport path is opened, and
during the turning the first frame part relative to the second frame part in the direction in which the transport path is opened, the idle gear revolves around the center of rotation of the drum while rotating on an axis thereof, whereby the reel rotates in the winding direction of the tape through the reel gear.

15. The sheet storage device of claim 13, wherein
the gear linkage drive has a second rotation preventer configured to prevent rotation of the reel gear and the reel during the turning of the first frame part relative to the second frame part in a direction in which the transport path is opened, and
during the turning of the first frame part relative to the second frame part in the direction in which the transport path is opened, the idle gear revolves around the center of rotation of the drum without rotating on an axis thereof, which causes the drum gear to rotate, whereby the drum rotates in the winding direction of the tape.

16. The sheet storage device of claim 11, wherein
the reel, the drum, or the reel and the drum, are supported by the second frame part, and
the gear linkage drive is coupled to the reel or the drum.

17. The sheet storage device of claim 16, wherein
the drum is supported by the second frame part,
the gear linkage drive has a drum gear linked to the drum, and a frame gear supported by the first frame part,
the frame gear is the first member, and
the drum gear rotates the drum in a direction in which the tape is wound, in response to the movement of the frame gear relative to the second frame part.

18. The sheet storage device of claim 16, wherein
the reel is supported by the second frame part,
the gear linkage drive has a reel gear linked to the reel, and a frame gear linked to the first frame part,
the frame gear is the first member, and
the reel gear rotates the reel in a direction in which the tape is wound, in response to the movement of the frame gear relative to the second frame part.

19. The sheet storage device of claim 16, wherein
the gear linkage drive has, as the first member, a frame gear supported by the first frame part,
the first frame part turns around a pivot shaft relative to the second frame part, and the frame gear turns around the pivot shaft in association with the turning of the first frame part relative to the second frame part, the gear linkage drive removes linkage between the frame gear and the second member in a state in which the first frame part and the second frame part forms the transport path, and during the turning of the first frame part relative to the second frame part, the gear linkage drive links the frame gear and the second member together to rotate the reel or the drum.

* * * * *